US011420308B2

(12) United States Patent
Kondo

(10) Patent No.: US 11,420,308 B2
(45) Date of Patent: Aug. 23, 2022

(54) IMPACT TOOL

(71) Applicant: MAKITA CORPORATION, Anjo (JP)

(72) Inventor: Tomoyuki Kondo, Anjo (JP)

(73) Assignee: MAKITA CORPORATION, Anjo (JP)

( * ) Notice: Subject to any disclaimer, the term of this patent is extended or adjusted under 35 U.S.C. 154(b) by 99 days.

(21) Appl. No.: 17/076,929

(22) Filed: Oct. 22, 2020

(65) Prior Publication Data

US 2021/0162571 A1 Jun. 3, 2021

(30) Foreign Application Priority Data

Dec. 2, 2019 (JP) ..... JP2019-218022

(51) Int. Cl.
*B25B 21/02* (2006.01)
*B25F 5/00* (2006.01)

(52) U.S. Cl.
CPC ..... *B25B 21/02* (2013.01); *B25F 5/001* (2013.01)

(58) Field of Classification Search
CPC ..... B25B 21/02; B25B 21/00; B25B 21/026; B25B 23/16; B25B 23/147; B25B 23/1475; B25B 23/1453; B25B 23/1405; B25B 19/00; B25D 11/04; B25D 11/066; B25D 16/00; B25D 16/003; B25D 16/006; B25D 2216/0023; B25F 5/026; B25F 5/001
USPC ..... 173/117, 90, 91, 93, 94, 128; 81/464
See application file for complete search history.

(56) References Cited

U.S. PATENT DOCUMENTS 6,138,772 A * 10/2000 Miescher ..... B25D 16/00 173/205
2006/0090913 A1* 5/2006 Furuta ..... B25D 16/003 173/48
2012/0132452 A1* 5/2012 Hoop ..... B25B 21/026 173/93.5
2013/0087355 A1* 4/2013 Oomori ..... B25B 21/02 173/94
2014/0374130 A1* 12/2014 Nakamura ..... B25B 23/1475 173/176

FOREIGN PATENT DOCUMENTS

DE 102015209406 A1 11/2016
JP 2002-224971 A 8/2002

* cited by examiner

*Primary Examiner* — Dariush Seif
(74) *Attorney, Agent, or Firm* — Oliff PLC

(57) ABSTRACT

An impact tool includes a second spring with restricted free movement. The impact tool includes a motor, a spindle rotatable with a rotational force generated by the motor, a hammer supported by the spindle in a manner movable in a front-rear direction and in a rotation direction, an anvil to be struck by the hammer in the rotation direction, a first spring constantly urging the hammer forward, a second spring that urges, forward, the hammer moving backward from a reference position, a hammer case accommodating the hammer, the first spring, and the second spring, and a movement restrictor that restricts movement of the second spring in an internal space of the hammer case.

23 Claims, 10 Drawing Sheets

〈HAMMER AT REFERENCE POSITION P0〉

〈HAMMER AT FIRST POSITION P1〉

IMPACT TOOL

CROSS-REFERENCE TO RELATED APPLICATIONS

This application claims the benefit of priority to Japanese Patent Application No. 2019-218022, filed on Dec. 2, 2019, the entire contents of which are hereby incorporated by reference.

BACKGROUND

1. Technical Field

The present disclosure relates to an impact tool.

2. Description of the Background

In the field of power tools, an impact rotating tool is known as described in Japanese Unexamined Patent Application Publication No. 2002-224971 (Patent Literature 1).

BRIEF SUMMARY

The impact rotating tool described in Patent Literature 1 includes a first spring having a larger strand diameter and a longer overall length, and a second spring having a smaller strand diameter and a shorter overall length. The impact rotating tool described in Patent Literature 1 may cause free movement of the second spring, producing abnormal noise.

One or more aspects of the present disclosure are directed to an impact tool including a second spring with restricted free movement.

An aspect of the present disclosure provides an impact tool, including:

- a motor;
- a spindle rotatable with a rotational force generated by the motor;
- a hammer supported by the spindle in a manner movable in a front-rear direction and in a rotation direction;
- an anvil configured to be struck by the hammer in the rotation direction;
- a first spring constantly urging the hammer forward;
- a second spring configured to urge, forward, the hammer moving backward from a reference position;
- a hammer case accommodating the hammer, the first spring, and the second spring; and
- a movement restrictor configured to restrict movement of the second spring in an internal space of the hammer case.

The impact tool according to the above aspect of the present disclosure includes the second spring with restricted free movement.

DETAILED DESCRIPTION

Although one or more embodiments of the present disclosure will now be described with reference to the drawings, the present disclosure is not limited to the present embodiments. The components in the embodiments described below may be combined as appropriate. One or more components may be eliminated.

In the embodiments, the positional relationships between the components will be described using the directional terms such as right and left (or lateral), front and rear (or forward and backward), and up and down. The terms indicate relative positions or directions with respect to the center of an impact tool 1.

The impact tool 1 includes a motor 6 and a spindle 8. The spindle 8 rotates with a rotational force generated by the motor 6. In the embodiments, a direction parallel to a rotation axis AX of the spindle 8 is referred to as an axial direction or axially for convenience. A direction about the rotation axis AX is referred to as a circumferential direction or circumferentially, or a rotation direction for convenience. A direction radial from the rotation axis AX is referred to as a radial direction or radially for convenience.

In the embodiments, the rotation axis AX extends in a front-rear direction. The axial direction corresponds to the front-rear direction. The axial direction is from the front to the rear or from the rear to the front.

A position nearer the rotation axis AX in the radial direction, or a radial direction toward the rotation axis AX, is referred to as radially inside or radially inward for convenience. A position farther from the rotation axis AX in the radial direction, or a radial direction away from the rotation axis AX, is referred to as radially outside or radially outward for convenience.

First Embodiment

Overview of Impact Tool

Figure 1:
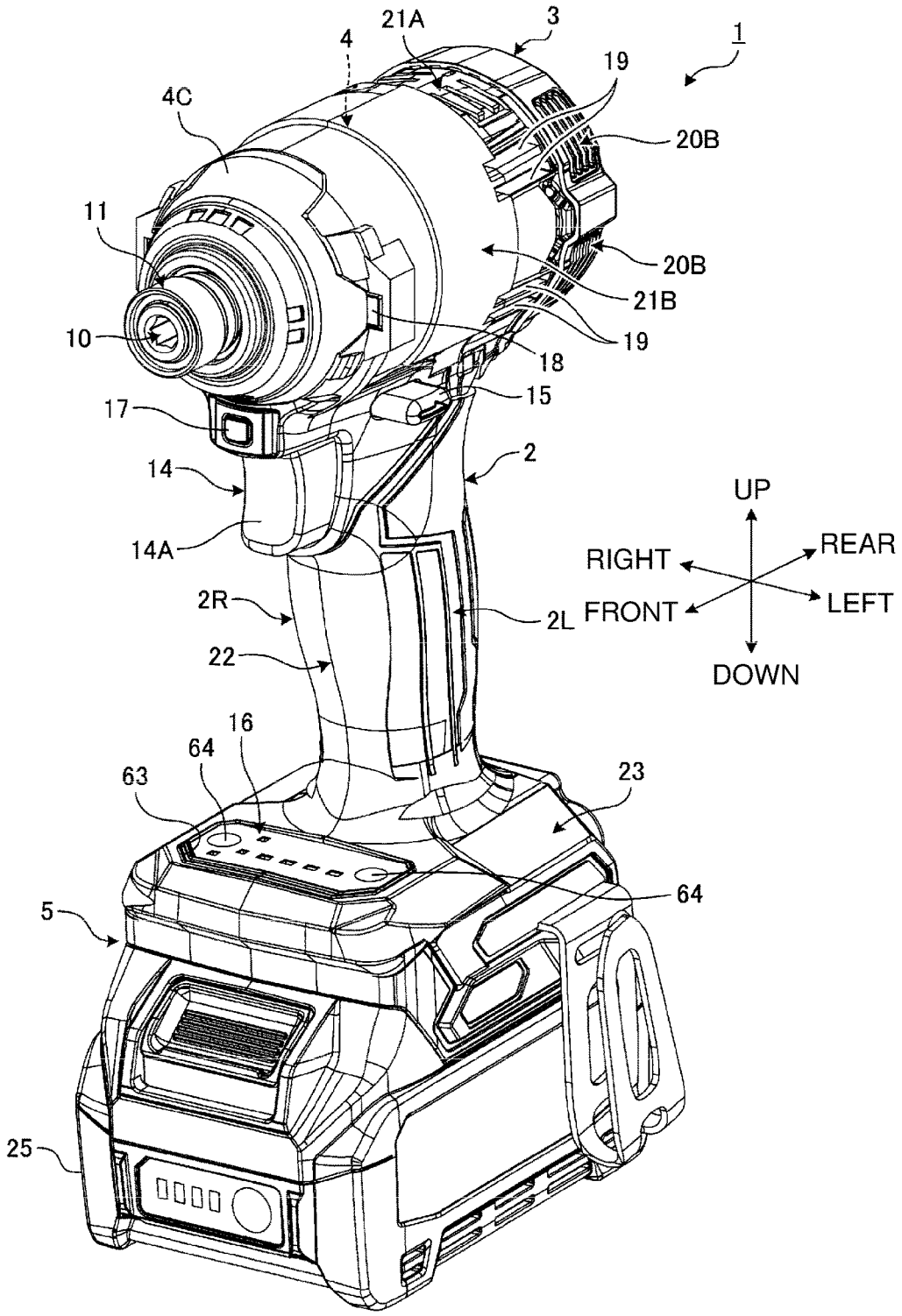
FIG. 1 is a perspective view of an impact tool according to a first embodiment.
Figure 2:
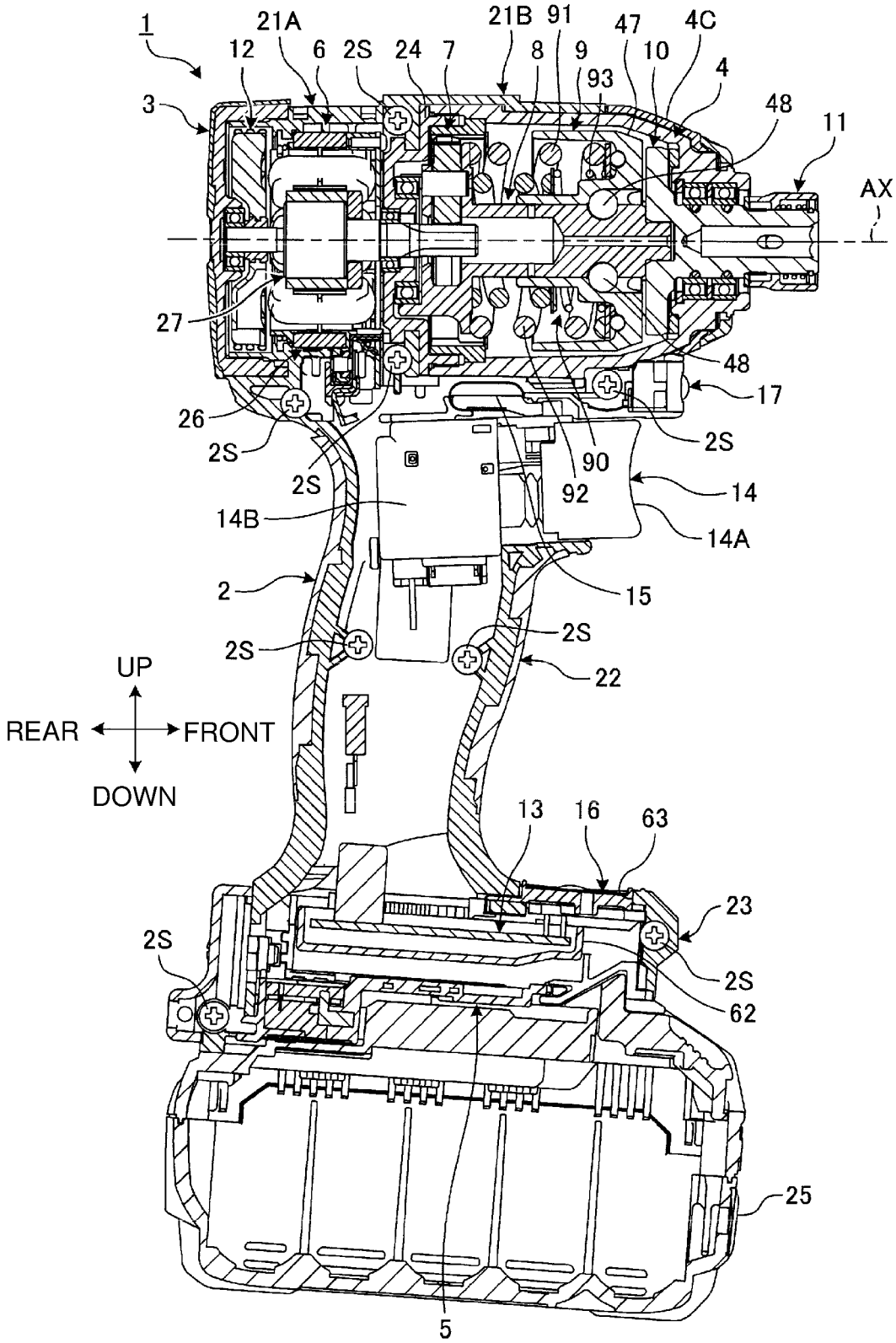
FIG. 2 is a longitudinal sectional view of the impact tool according to the first embodiment.
Figure 3:
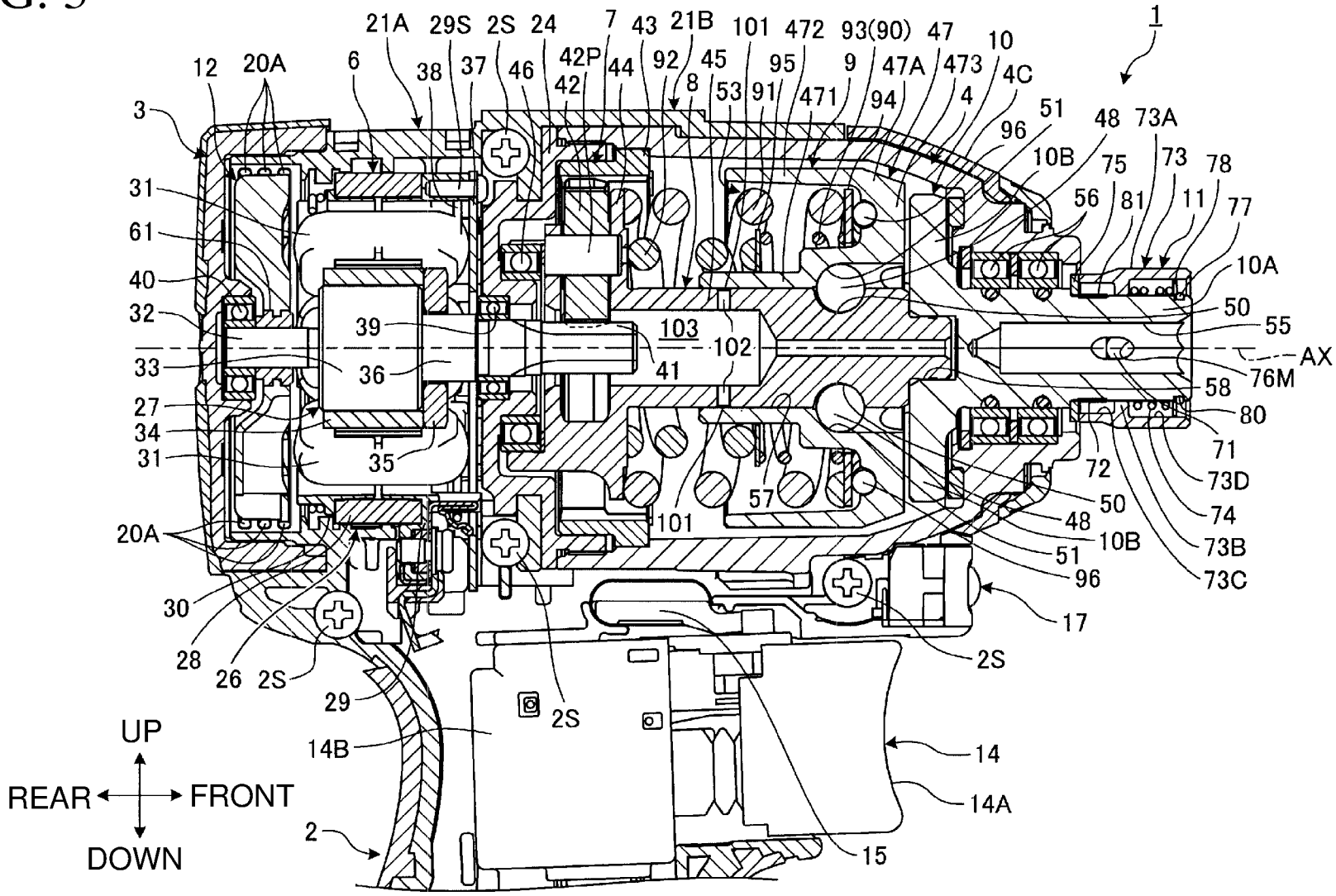
FIG. 3 is a partially enlarged longitudinal sectional view of the impact tool according to the first embodiment.
Figure 4:
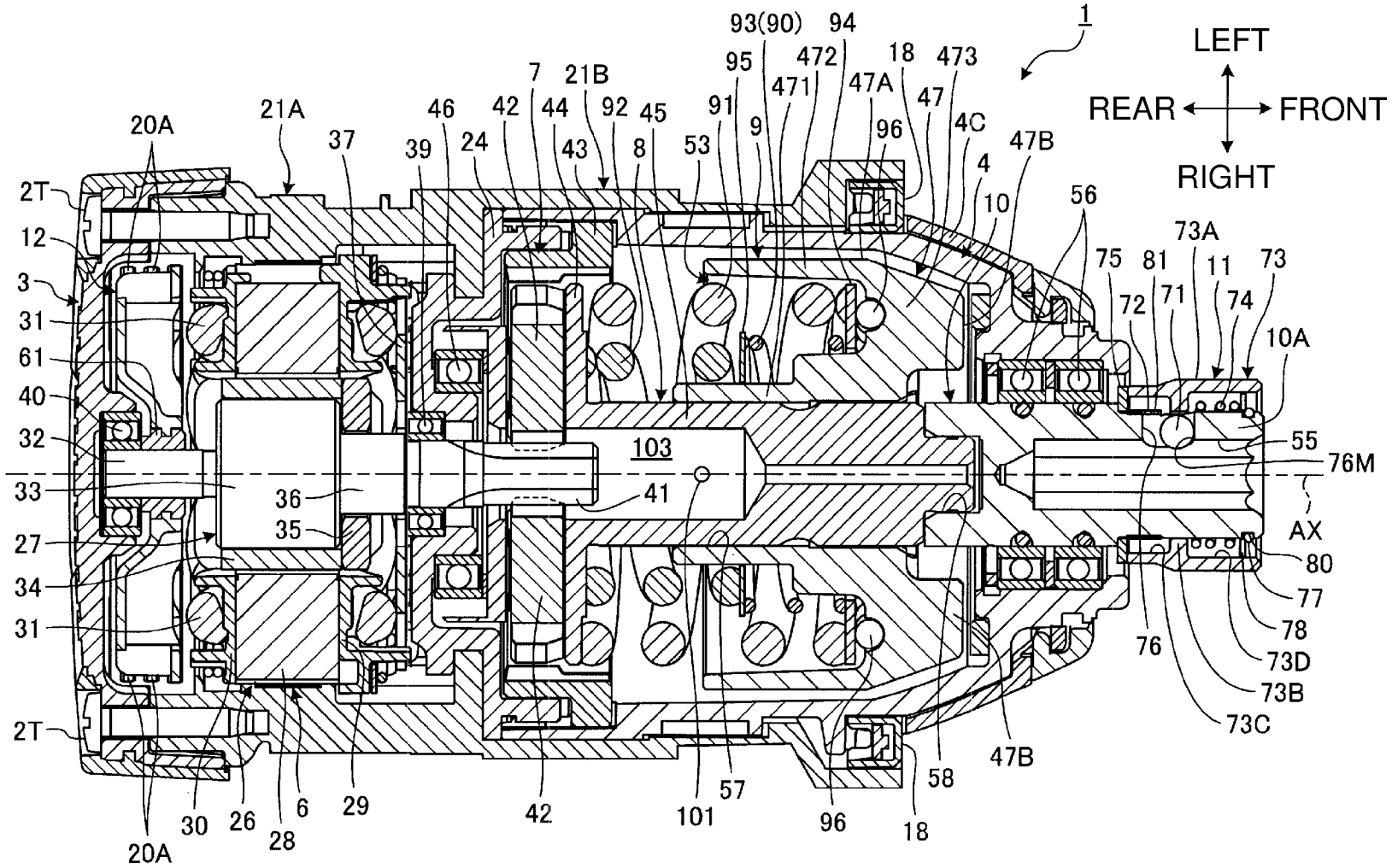
FIG. 4 is a partially enlarged transverse sectional view of the impact tool according to the first embodiment.

FIG. 1 is a perspective view of the impact tool 1 according to the present embodiment. FIG. 2 is a longitudinal sectional view of the impact tool 1 according to the present embodiment. FIG. 3 is a partially enlarged longitudinal sectional view of the impact tool 1 according to the present embodiment. FIG. 4 is a partially enlarged transverse sectional view of the impact tool 1 according to the present embodiment. The impact tool 1 is an impact driver including an impact mechanism 9 and an anvil 10.

As shown in FIGS. 1 to 4, the impact tool 1 includes a housing 2, a rear case 3, a hammer case 4, a battery mount 5, the motor 6, a reduction mechanism 7, the spindle 8, the impact mechanism 9, the anvil 10, a tool holder 11, a fan 12, a controller 13, a trigger switch 14, a forward-reverse switch lever 15, an operation panel 16, a mode switch 17, and lamps 18.

The housing 2 is formed from a synthetic resin. The housing 2 in the present embodiment is formed from nylon.

The housing 2 includes a pair of housing halves. The housing 2 includes a left housing 2L and a right housing 2R. The right housing 2R is located on the right of the left housing 2L. The left and right housings 2L and 2R are fastened together with multiple screws 2S.

The housing 2 includes a motor compartment 21A, a hammer case covering portion 21B, a grip 22, and a controller compartment 23. The grip 22 is located below the motor compartment 21A. The controller compartment 23 is located below the grip 22 and the hammer case covering portion 21B.

The motor compartment 21A is cylindrical. The motor compartment 21A accommodates at least a part of the motor 6.

The hammer case covering portion 21B covers the hammer case 4. The hammer case covering portion 21B is located in front of the motor compartment 21A.

The grip 22 protrudes downward from the motor compartment 21A and the hammer case covering portion 21B. The trigger switch 14 is located on an upper portion of the grip 22. The grip 22 is gripped by an operator.

The controller compartment 23 is connected to a lower end of the grip 22. The controller compartment 23 accommodates the controller 13. The controller compartment 23 has larger outer dimensions than the grip 22 in the front-rear and left-right directions.

The rear case 3 is formed from a synthetic resin. The rear case 3 is connected to a rear portion of the motor compartment 21A. The rear case 3 covers a rear opening of the motor compartment 21A. The rear case 3 is fastened to the motor compartment 21A with screws 2T. The rear case 3 accommodates at least a part of the fan 12.

The motor compartment 21A has inlets 19, and first outlets 20A behind the motor compartment 21A. The rear case 3 has second outlets 20B. Air outside the housing 2 flows into the internal space of the housing 2 through the inlets 19. Air in the internal space of the housing 2 passes through the first outlets 20A and then the second outlets 20B. Air in the internal space of the housing 2 flows out of the housing 2 through the first and second outlets 20A and 20B.

The hammer case 4 is formed from a metal. The hammer case 4 in the present embodiment is formed from aluminum. The hammer case 4 is cylindrical. The hammer case 4 has a smaller inner diameter in its front portion than in its rear portion. The hammer case 4 is located in front of the motor compartment 21A. The hammer case 4 has a rear portion and a middle portion covered by the hammer case covering portion 21B. The hammer case 4 has a front portion covered by a hammer case cover 4C, and a rear portion connected to a bearing retainer 24. The bearing retainer 24 is located at least partially in the hammer case 4.

The hammer case 4 accommodates at least parts of the reduction mechanism 7, the spindle 8, the impact mechanism 9, and the anvil 10. The reduction mechanism 7 is located at least partially inside the bearing retainer 24.

The battery mount 5 is located below the controller compartment 23. A battery pack 25 is attached to the battery mount 5 in a detachable manner. The battery pack 25 may be a secondary battery. The battery pack 25 in the present embodiment may be a rechargeable lithium-ion battery. The battery pack 25 is attached to the battery mount 5 to power the impact tool 1. The motor 6 is driven by power supplied from the battery pack 25. The controller 13 operates on power supplied from the battery pack 25.

The motor 6 is a power source for the impact tool 1. The motor 6 is a brushless inner-rotor motor. The motor 6 includes a stator 26 and a rotor 27. The rotor 27 is located inside the stator 26.

The stator 26 includes a stator core 28, a front insulator 29, a rear insulator 30, and multiple coils 31. The front insulator 29 is located on the front of the stator core 28. The rear insulator 30 is located on the rear of the stator core 28. The coils 31 are wound around the stator core 28 with the front insulator 29 and the rear insulator 30 in between.

The stator core 28 includes multiple steel plates stacked on one another. The steel plates are metal plates formed from iron as a main component. The stator core 28 is cylindrical. The stator core 28 has multiple teeth to support the coils 31. The front insulator 29 and the rear insulator 30 are electrical insulating members formed from a synthetic resin. The front insulator 29 partially covers the surfaces of the teeth. The rear insulator 30 partially covers the surfaces of the teeth. The coils 31 surround the teeth with the front insulator 29 and the rear insulator 30 in between. The coils 31 and the stator core 28 are electrically insulated from each other with the front insulator 29 and the rear insulator 30.

The rotor 27 rotates about its rotation axis. The rotation axis of the rotor 27 aligns with the rotation axis AX of the spindle 8. The rotor 27 includes a rotor shaft 32, a rotor core 33, a permanent magnet 34, and a sensor permanent magnet 35. The rotor core 33 surrounds the rotor shaft 32. The permanent magnet 34 surrounds the rotor core 33. The rotor shaft 32 extends in the front-rear direction. The rotor core 33 is fastened to the rotor shaft 32. The rotor core 33 is cylindrical. The rotor core 33 includes multiple steel plates stacked on one another. The rotor shaft 32 and the rotor core 33 may be formed as a single member. The permanent magnet 34 is cylindrical. The permanent magnet 34 includes first permanent magnets with a first polarity and second permanent magnets with a second polarity. The first permanent magnets and the second permanent magnets alternate in the circumferential direction in the cylindrical permanent magnet 34. The sensor permanent magnet 35 is located in front of the rotor core 33 and the permanent magnet 34. A resin sleeve 36 is located at least partially inside the sensor permanent magnet 35. The resin sleeve 36 is cylindrical. The resin sleeve 36 is attached to a front portion of the rotor shaft 32.

A sensor board 37 and a coil terminal 38 are attached to the front insulator 29. The sensor board 37 and the coil terminal 38 are fastened to the front insulator 29 with a screw 29S. The sensor board 37 includes an annular circuit board, and a rotation detector supported on the circuit board. The rotation detector detects the position of the sensor permanent magnet 35 to detect the position of the rotor 27 in the rotation direction. The coil terminal 38 connects the multiple coils 31 to three power supply lines extending from the controller 13.

The rotor shaft 32 is rotatably supported by a front bearing 39 and a rear bearing 40. The front bearing 39 is held by the bearing retainer 24. The rear bearing 40 is held by the rear case 3. The front bearing 39 supports the front portion of the rotor shaft 32. The rear bearing 40 supports the rear end of the rotor shaft 32. The front end of the rotor shaft 32 is located in the internal space of the hammer case 4 through an opening of the bearing retainer 24.

A pinion gear 41 is located at the front end of the rotor shaft 32. The rotor shaft 32 is connected to the reduction mechanism 7 via the pinion gear 41.

The reduction mechanism 7 is located in front of the motor 6. The reduction mechanism 7 connects the rotor shaft 32 and the spindle 8 together. The reduction mechanism 7 transmits a rotational force generated by the motor 6 to the spindle 8. The reduction mechanism 7 rotates the spindle 8 at a lower rotational speed than the rotor shaft 32. The reduction mechanism 7 includes a planetary gear assembly.

The reduction mechanism 7 includes multiple planetary gears 42 and an internal gear 43. The multiple planetary gears 42 surround the pinion gear 41. The internal gear 43 surrounds the multiple planetary gears 42. The reduction mechanism 7 in the present embodiment includes three planetary gears 42. Each of the planetary gears 42 meshes with the pinion gear 41. The planetary gears 42 are rotatably supported by the spindle 8 via a pin 42P. The internal gear 43 includes internal teeth that mesh with the planetary gears 42. The internal gear 43 is fixed to the hammer case 4. The internal gear 43 is nonrotatable relative to the hammer case 4.

When the rotor shaft 32 rotates as driven by the motor 6, the pinion gear 41 rotates, and the planetary gears 42 revolve about the pinion gear 41. The planetary gears 42 revolve while meshing with the internal teeth of the internal gear 43. The revolving planetary gears 42 rotate the spindle 8, connected to the planetary gears 42 via the pin 42P, at a lower rotational speed than the rotor shaft 32.

The spindle 8 is located frontward from the motor 6. The spindle 8 is located at least partially frontward from the reduction mechanism 7. The spindle 8 includes a flange 44 and a rod 45. The rod 45 protrudes frontward from the flange 44. The rod 45 extends in the front-rear direction. The planetary gears 42 are rotatably supported by the flange 44 via the pins 42P.

The spindle 8 rotates with a rotational force generated by the motor 6. The spindle 8 rotates about the rotation axis AX. The spindle 8 is rotatably supported by a rear bearing 46. The rear bearing 46 is held by the bearing retainer 24. The rear bearing 46 supports the rear end of the spindle 8.

The spindle 8 has feed ports 101 for feeding lubricating oil to around the spindle 8. The lubricating oil includes grease. The feed ports 101 are located on the rod 45. The spindle 8 has an internal space 103 to contain the lubricating oil. The feed ports 101 connect with the internal space 103 through a flow channel 102. The lubricating oil is fed to at least partially around the spindle 8 through the feed ports 101 with a centrifugal force from the spindle 8.

The impact mechanism 9 strikes the anvil 10 in the rotation direction in response to rotation of the spindle 8. The impact mechanism 9 includes a hammer 47, balls 48, a first spring 91, a second spring 92, and a movement restrictor 90. The hammer 47 is supported by the spindle 8 in a manner movable in the front-rear direction and in the rotation direction. The balls 48 are placed between the spindle 8 and the hammer 47. The first spring 91 constantly urges the hammer 47 forward. The second spring 92 urges, forward, the hammer 47 moving backward from a reference position. The movement restrictor 90 restricts movement of the second spring 92. The impact mechanism 9 will be described in detail later.

In the present embodiment, the lubricating oil is fed through the feed ports 101 to between the rod 45 and the hammer 47. The lubricating oil fed to between the rod 45 and the hammer 47 is at least partially fed onto the surfaces of the balls 48. The lubricating oil fed to between the rod 45 and the hammer 47 is also at least partially fed onto the surface of the first spring 91, the surface of the second spring 92, and the surface of the movement restrictor 90.

The anvil 10 is located at least partially frontward from the hammer 47. The anvil 10 rotates about its rotation axis with a rotational force transmitted from the motor 6. The rotation axis of the anvil 10 aligns with the rotation axis AX of the spindle 8. The anvil 10 is rotatable together with or relative to the spindle 8. The anvil 10 is rotatable together with or relative to the hammer 47. The anvil 10 is rotatably supported by a pair of front bearings 56. The pair of front bearings 56 are held by the hammer case 4. The anvil 10 is struck by the hammer 47 in the rotation direction.

The anvil 10 includes a rod-like anvil body 10A and anvil protrusions 10B. The anvil protrusions 10B are located in a rear portion of the anvil body 10A. The anvil body 10A has an insertion hole 55 to receive a tip tool. The insertion hole 55 extends rearward from the front end of the anvil body 10A. The tip tool is attached to the anvil body 10A. The anvil 10 has two anvil protrusions 10B. The anvil protrusions 10B protrude radially outward from the rear portion of the anvil body 10A.

The anvil 10 has a hole 58 to receive the front end of the rod 45. The hole 58 is formed in the rear end of the anvil 10. The front end of the rod 45 is received in the hole 58. The rod 45 has its front end received in the hole 58. The spindle 8 thus serves as a bearing for the anvil 10 and the anvil 10 serves as a bearing for the spindle 8.

The tool holder 11 surrounds a front portion of the anvil 10. The tool holder 11 holds a tip tool received in the insertion hole 55 in the anvil 10. The tip tool is attachable to and detachable from the tool holder 11.

The tool holder 11 includes a ball 71, a leaf spring 72, a sleeve 73, a coil spring 74, and a positioner 75.

The anvil 10 has a supporting recess 76 for supporting the ball 71. The supporting recess 76 is formed on the outer surface of the anvil body 10A. The supporting recess 76 is located in a middle portion of the anvil body 10A in the axial direction. The supporting recess 76 is elongated in the axial direction. In the present embodiment, the anvil body 10A has the single supporting recess 76.

The ball 71 is supported on the anvil 10 in a movable manner. The ball 71 is received in the supporting recess 76 on the anvil body 10A. The single ball 71 is received in the single supporting recess 76. The tool holder 11 according to the present embodiment includes the single ball 71 on the periphery of the anvil body 10A.

The anvil body 10A has a through-hole 76M. The through-hole 76M connects the inner surface of the supporting recess 76 and the inner surface of the insertion hole 55. The ball 71 has a larger diameter than the through-hole 76M. The ball 71 supported in the supporting recess 76 is received at least partially in the insertion hole 55 through the through-hole 76M. In other words, the ball 71 supported in the supporting recess 76 protrudes at least partially into the insertion hole 55 through the through-hole 76M.

The ball 71 fastens a tip tool received in the insertion hole 55. The ball 71 is movable in the axial and radial directions while being in contact with the inner surface of the supporting recess 76. The ball 71 can move between an engagement position at which the ball 71 fastens the tip tool and a release position at which the ball 71 unfastens the tip tool.

As described above, the ball 71 is received at least partially in the insertion hole 55 through the through-hole 76M. The tip tool has a groove on its side surface. The ball 71 is received at least partially in the groove on the tip tool to fasten the tip tool. The ball 71 received at least partially in the groove on the tip tool positions the tip tool in the axial, radial, and circumferential directions. The engagement position of the ball 71 includes the position of the ball 71 received at least partially in the groove on the tip tool. The release position of the ball 71 includes the position of the ball 71 placed outside the groove on the tip tool.

The leaf spring 72 generates an elastic force for moving the ball 71 to the engagement position. The leaf spring 72 surrounds the anvil body 10A. The leaf spring 72 generates an elastic force for moving the ball 71 forward.

The sleeve 73 is cylindrical. The sleeve 73 surrounds the anvil body 10A. The sleeve 73 is movable in the axial direction around the anvil body 10A. The sleeve 73 restricts the ball 71 from coming out of the engagement position. The sleeve 73 moves in the axial direction to permit the ball 71 to be movable from the engagement position to the release position.

The sleeve 73 is movable between a movement-restricting position and a movement-permitting position around the anvil body 10A. At the movement-restricting position, the sleeve 73 restricts radially outward movement of the ball 71. At the movement-permitting position, the sleeve 73 permits radially outward movement of the ball 71.

The sleeve 73 at the movement-restricting position restricts the ball 71 at the engagement position from moving radially outward. In other words, the sleeve 73 at the movement-restricting position restricts the ball 71 from coming out of the engagement position. The sleeve 73 at the movement-restricting position causes the tip tool to be fastened with the ball 71.

The sleeve 73 moves to the movement-permitting position to permit the ball 71 at the engagement position to move radially outward. The sleeve 73 moves to the movement-permitting position to permit the ball 71 to move from the engagement position to the release position. In other words, the sleeve 73 at the movement-permitting position permits the ball 71 to come out of the engagement position. The sleeve 73 at the movement-permitting position causes the tip tool, fastened with the ball 71, to be unfastened.

The coil spring 74 generates an elastic force for moving the sleeve 73 to the movement-restricting position. The coil spring 74 surrounds the anvil body 10A. The movement-restricting position is defined rearward from the movement-permitting position. The coil spring 74 generates an elastic force for moving the sleeve 73 backward.

The positioner 75 is annular and is fastened on an outer surface of the anvil body 10A. The positioner 75 is fastened to face the rear end of the sleeve 73. The positioner 75 positions the sleeve 73 at the movement-restricting position. The sleeve 73 under an elastic force from the coil spring 74 for moving backward comes in contact with the positioner 75 and is positioned at the movement-restricting position.

The sleeve 73 includes a cylindrical sleeve body 73A, a protrusion 73B, a first groove 73C, and a second groove 73D. The protrusion 73B protrudes radially inward from an inner surface of the sleeve body 73A and can come in contact with the anvil body 10A. The first groove 73C is located rearward from the protrusion 73B and faces the anvil body 10A. The second groove 73D is located frontward from the protrusion 73B and faces the anvil body 10A. The protrusion 73B can come in contact with the ball 71 in addition to the anvil body 10A. The leaf spring 72 is received in the first groove 73C. The coil spring 74 is received in the second groove 73D.

The protrusion 73B is located frontward from the leaf spring 72. The protrusion 73B extends radially inward from the inner surface of the sleeve body 73A. The protrusion 73B is annular.

The protrusion 73B has a front surface facing frontward, a rear surface facing rearward, and an inner surface facing radially inward. The inner surface of the protrusion 73B can come in contact with the outer surface of the anvil body 10A. The inner surface of the protrusion 73B can come in contact with the ball 71.

The anvil body 10A includes a stop ring 77 located frontward from the supporting recess 76. The outer surface of the anvil body 10A has a groove 80 located frontward from the supporting recess 76. The stop ring 77 is received at least partially in the groove 80. A stopper 78 is located behind the stop ring 77. The stopper 78 is annular. The stopper 78 is positioned by the stop ring 77.

The coil spring 74 has a rear end that can come in contact with the front surface of the protrusion 73B, and a front end that can come in contact with the stopper 78. The front end of the coil spring 74 is connected to the anvil body 10A with the stopper 78 and the stop ring 77 in between. The rear end of the coil spring 74 comes in contact with the protrusion 73B on the sleeve 73. The coil spring 74 thus generates an elastic force for moving the sleeve 73 backward.

The leaf spring 72 at least partially surrounds the anvil body 10A to face the supporting recess 76. The outer surface of the anvil body 10A has a groove 81 located rearward from the supporting recess 76. The groove 81 faces the sleeve 73. The leaf spring 72 is received in the groove 81.

The leaf spring 72 has a front end that can come in contact with the ball 71, and a rear end that can come in contact with the rear end wall surface of the groove 81. The leaf spring 72 thus generates an elastic force for moving the ball 71 forward.

The operation for attaching a tip tool to the anvil 10 will now be described. Before the tip tool is attached to the anvil 10, the sleeve 73 moves backward under an elastic force from the coil spring 74. The coil spring 74 generates an elastic force for moving the sleeve 73 to the movement-restricting position. The rear end of the sleeve 73 comes in contact with the positioner 75. The positioner 75 positions the sleeve 73 at the movement-restricting position.

When the sleeve 73 is placed at the movement-restricting position, the protrusion 73B is located radially outside the ball 71, restricting radially outward movement of the ball 71.

After the tip tool starts being inserted into the insertion hole 55, the tip tool at least partially comes in contact with the ball 71. The ball 71 in contact with the tip tool moves backward inside the supporting recess 76.

When the tip tool is moved further backward, the ball 71 in contact with the tip tool moves radially outward and comes in contact with the leaf spring 72.

When the tip tool is moved further backward to move the ball 71 radially outward, the leaf spring 72 in contact with the ball 71 deforms to have an increased diameter.

When the ball 71 moves radially outward, the surface of the ball 71 at least partially comes in contact with the rear surface of the protrusion 73B, causing the sleeve 73 to move forward. In other words, the ball 71 moving radially outward comes in contact with the rear surface of the protrusion 73B to move the sleeve 73 to the movement-permitting position.

The sleeve 73 at the movement-permitting position causes the ball 71 to move radially outward. The ball 71 is received at least partially in the first groove 73C. The release position of the ball 71 includes the position of the ball 71 received at least partially in the first groove 73C. In this state, the leaf spring 72 at least partially has an increased diameter and is placed radially outside the ball 71.

With the ball 71 moving radially outward to the release position, the tip tool can be smoothly inserted into the insertion hole 55. The tip tool moves backward while being in contact with the ball 71.

When the tip tool is moved further backward and the groove on the tip tool is placed radially inside the ball 71, the leaf spring 72 generates an elastic force for moving the ball 71 to the engagement position. The elastic force of the leaf spring 72 causes the ball 71 to move forward inside the supporting recess 76. The ball 71 moving forward inside the supporting recess 76 is received at least partially in the insertion hole 55 through the through-hole 76M. The ball 71 is received at least partially in the groove on the tip tool. The ball 71 is also at least partially supported in the supporting recess 76. The engagement position of the ball 71 includes the position of the ball 71 received at least partially in the groove on the tip tool. The ball 71 is placed at the engagement position to fasten the tip tool. The tip tool is fastened to the anvil body 10A with the ball 71.

The ball 71 at the engagement position causes the sleeve 73 to move backward under an elastic force from the coil spring 74. The sleeve 73 moving backward comes in contact with the positioner 75 and is positioned at the movement-restricted position. In this state, the protrusion 73B is located radially outside the ball 71. When the ball 71 is at the engagement position, the inner surface of the protrusion 73B is in contact with at least a part of the surface of the ball 71. The protrusion 73B in contact with the ball 71 restricts radially outward movement of the ball 71. The tip tool thus remains fastened with the ball 71.

When the tip tool is inserted in the insertion hole 55 with the sleeve 73 unoperated, the leaf spring 72 elastically deforms, forcing the ball 71 into the groove on the tip tool. Once the ball 71 is forced into the groove on the tip tool, the leaf spring 72 abruptly has a reduced diameter. The ball 71 is forced into the groove on the tip tool and hits the inner surface of the groove on the tip tool, producing sound. The operator can then confirm that the tip tool has been fastened to the anvil 10.

The operation for detaching the tip tool from the anvil 10 will now be described. To detach the tip tool from the anvil 10, the operator moves the tip tool forward. The ball 71, which is in contact with the tip tool, then moves radially outward. The operator also operates the sleeve 73 to move the sleeve 73 forward.

When the sleeve 73 moves forward to the movement-permitting position, the first groove 73C is located radially outside the ball 71. When the tip tool is moved further forward in this state, the ball 71 comes out of the groove on the tip tool, and moves radially outward while being in contact with the outer surface of the tip tool. The ball 71 moving radially outward is received at least partially in the first groove 73C.

With the ball 71 moving radially outward to the release position, the tip tool can move smoothly. The tip tool moves forward while being in contact with the surface of the ball 71.

When the tip tool is moved forward with the ball 71 being at the release position, the tip tool is pulled out of the insertion hole 55. The tip tool is thus detached from the anvil 10.

The fan 12 is located behind the motor 6. The fan 12 generates an airflow for cooling the motor 6. The fan 12 is fastened to at least a part of the rotor 27. The fan 12 is fastened to a rear portion of the rotor shaft 32 with a bush 61. The fan 12 is between the rear bearing 40 and the rotor core 33. The fan 12 rotates as the rotor 27 rotates. As the rotor shaft 32 rotates, the fan 12 rotates together with the rotor shaft 32. Thus, air outside the housing 2 flows into the internal space of the housing 2 through the inlets 19. Air flowing into the internal space of the housing 2 flows through the housing 2 and cools the motor 6. The air passing through the housing 2 flows out of the housing 2 through the first and second outlets 20A and 20B.

The controller 13 is accommodated in the controller compartment 23. The controller 13 outputs control signals for controlling the motor 6. The controller 13 includes a board on which multiple electronic components are mounted. Examples of the electronic components mounted on the board include a processor such as a central processing unit (CPU), a nonvolatile memory such as a read-only memory (ROM) or a storage device, a volatile memory such as a random-access memory (RAM), a field-effect transistor (FET), and a resistor. For example, six FETs are mounted on the board.

The controller 13 is at least partially accommodated in a controller case 62. The controller case 62 is located in the internal space of the controller compartment 23. The controller 13 changes the control mode of the motor 6 in accordance with the operator's operation on the operation panel 16. The control mode of the motor 6 refers to a method or pattern for controlling the motor 6.

The trigger switch 14 is located on an upper portion of the grip 22. The trigger switch 14 is operable by the operator to activate the motor 6. The trigger switch 14 includes a trigger 14A and a switch body 14B. The switch body 14B is located in the internal space of the grip 22. The trigger 14A protrudes frontward from the upper front of the grip 22. The trigger 14A is operated by the operator to move backward. Thus, the motor 6 is driven. When the trigger 14A stops being operated, the motor 6 is stopped.

The forward-reverse switch lever 15 is between the lower end of the hammer case covering portion 21B and the upper end of the grip 22. The forward-reverse switch lever 15 is operated by the operator to move left or right. The forward-reverse switch lever 15 is operated to switch the rotation direction of the motor 6 between forward and reverse. This operation switches the rotation direction of the spindle 8.

The operation panel 16 is located in the controller compartment 23. The operation panel 16 is formed from a synthetic resin. The operation panel 16 is a plate. The controller compartment 23 has an opening 63 to receive the operation panel 16. The opening 63 is formed in the upper surface of the controller compartment 23 frontward from the grip 22. The operation panel 16 is received at least partially in the opening 63. The operation panel 16 includes multiple operation switches 64. The operation switches 64 are operable by the operator to change the control mode of the motor 6.

The mode switch 17 is located above the trigger 14A. The mode switch 17 is operable by the operator. The mode switch 17 is operated to move backward to switch the control mode of the motor 6.

The lamps 18 are located on the left and right of the hammer case 4. The lamps 18 emit light to illuminate ahead of the impact tool 1. The lamps 18 include, for example, light-emitting diodes (LEDs).

Impact Mechanism

Figure 5:
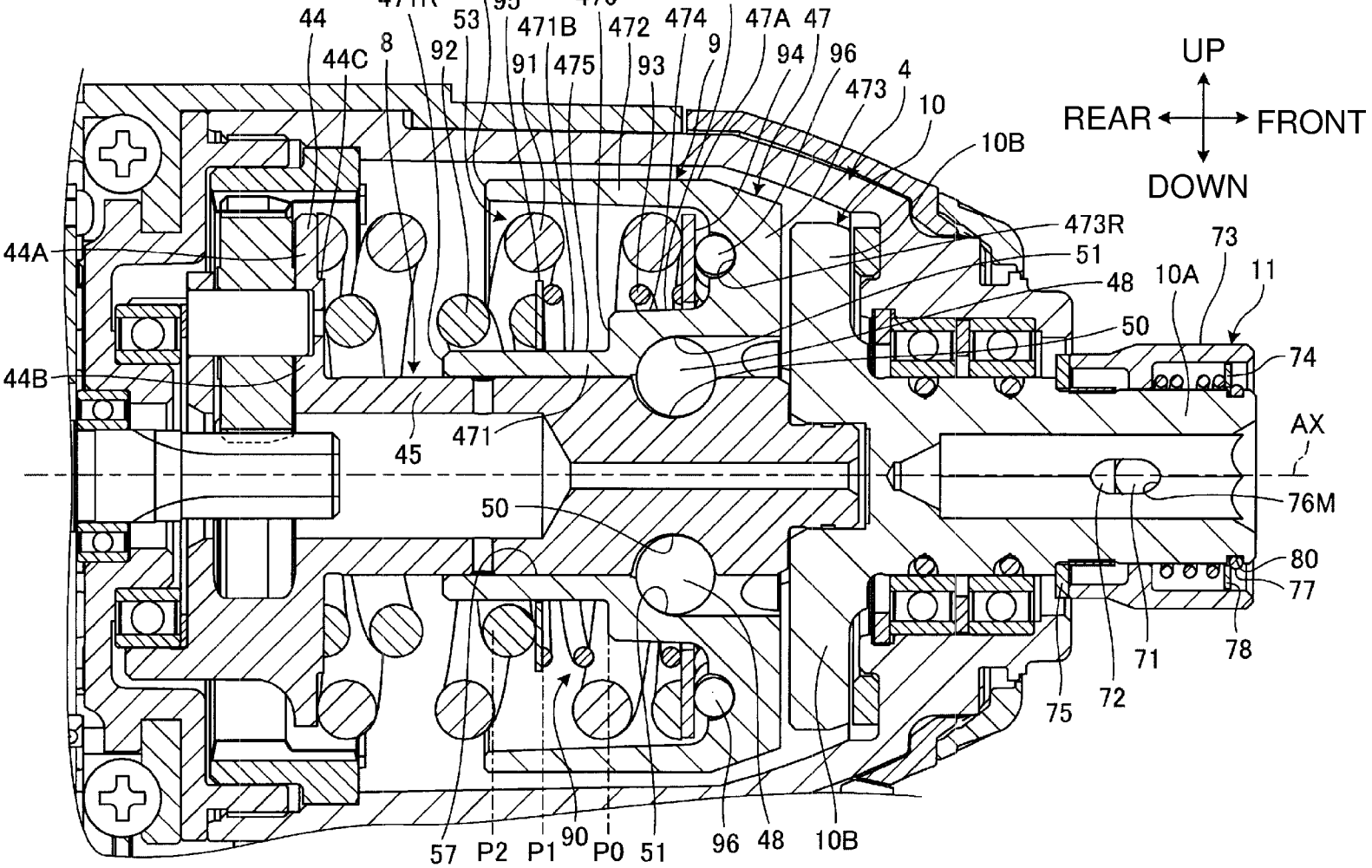
FIG. 5 is a longitudinal sectional view of an impact mechanism according to the first embodiment.

The impact mechanism 9 will now be described. FIG. 5 is a longitudinal sectional view of the impact mechanism 9 according to the present embodiment. FIG. 5 corresponds to an enlarged view of a part of FIG. 3. As shown in FIGS. 3 to 5, the impact mechanism 9 includes the hammer 47, the balls 48, the first spring 91, the second spring 92, the movement restrictor 90, a first washer 94, and a second washer 95. The hammer 47 is supported by the spindle 8 in a manner movable in the front-rear direction and in the rotation direction. The balls 48 are placed between the spindle 8 and the hammer 47. The first spring 91 constantly urges the hammer 47 forward. The second spring 92 urges, forward, the hammer 47 moving backward from the reference position. The movement restrictor 90 restricts movement of the second spring 92. The first washer 94 is supported by the hammer 47. The second washer 95 is located rearward from the first washer 94 and is supported by the hammer 47.

The movement restrictor 90 restricts movement of the second spring 92 in at least one of the front-rear direction or the rotation direction. The movement restrictor 90 according to the present embodiment includes a third spring 93 for urging the second spring 92.

The hammer 47, the balls 48, the first spring 91, the second spring 92, the third spring 93, the first washer 94, and the second washer 95 are accommodated in the hammer case 4. The movement restrictor 90 including the third spring 93 restricts movement of the second spring 92 in the internal space of the hammer case 4. In other words, the movement restrictor 90 restricts free movement of the second spring 92 in the internal space of the hammer case 4.

The hammer 47 is located frontward from the reduction mechanism 7. The hammer 47 includes a cylindrical hammer body 47A and hammer protrusions 47B. The hammer protrusions 47B are located in front of the hammer body 47A. The hammer body 47A surrounds the rod 45 of the spindle 8. The hammer body 47A has a hole 57 to receive the rod 45 of the spindle 8. The hammer 47 has two hammer protrusions 47B. The hammer protrusions 47B protrude frontward from the front of the hammer body 47A.

The hammer 47 is rotatable together with the spindle 8. The hammer 47 is movable relative to the spindle 8 in the front-rear direction and in the rotation direction. The hammer 47 rotates about its rotation axis. The rotation axis of the hammer 47 aligns with the rotation axis AX of the spindle 8.

The hammer body 47A includes an inner cylinder 471, an outer cylinder 472, and a base 473. The inner cylinder 471 surrounds the rod 45. The inner surface of the inner cylinder 471 is in contact with the outer surface of the rod 45. The outer cylinder 472 is located radially outside the inner cylinder 471. The base 473 is connected to the front end of the inner cylinder 471 and to the front end of the outer cylinder 472. The hammer protrusions 47B protrude frontward from the front surface of the base 473.

The inner cylinder 471, the outer cylinder 472, and the base 473 define a recess 53. The recess 53 is recessed frontward from the rear end of the hammer 47. The recess 53 is annular in a plane orthogonal to the rotation axis AX.

The inner cylinder 471 in the hammer 47 includes a larger-diameter portion 471A and a smaller-diameter portion 471B. The smaller-diameter portion 471B is located rearward from the larger-diameter portion 471A. The larger-diameter portion 471A has an outer surface 474 with a larger outer diameter than an outer surface 475 of the smaller-diameter portion 471B. The inner cylinder 471 has a step at the boundary between the rear end of the larger-diameter portion 471A at the outer surface 474 and the front end of the smaller-diameter portion 471B at the outer surface 475. The inner cylinder 471 in the hammer 47 further has a rear surface 476 between the outer surface 474 of the larger-diameter portion 471A and the outer surface 475 of the smaller-diameter portion 471B. The rear surface 476, facing rearward, is substantially orthogonal to the rotation axis AX.

The inner cylinder 471 has a rear end 471R located rearward from a rear end 472R of the outer cylinder 472.

The inner cylinder 471 has the rear end 471R located rearward from the second washer 95, and radially inside the second spring 92. The inner cylinder 471 has the rear end 471R at the same position as at least a part of the second spring 92 in the front-rear direction.

The outer cylinder 472 has the rear end 472R rearward from the second washer 95, radially outside the second spring 92, and radially outside the first spring 91. The outer cylinder 472 has the rear end 472R at the same position as at least a part of the second spring 92 in the front-rear direction. The outer cylinder 472 has the rear end 472R at the same position as at least a part of the first spring 91 in the front-rear direction.

With both the inner cylinder 471 and the outer cylinder 472 having their rear ends 471R and 472R located rearward from the second washer 95, the recess 53 is less likely to reduce the impact force (inertial force) from the hammer 47.

The balls 48 are placed between the rod 45 of the spindle 8 and the hammer 47. The balls 48 are formed from a metal such as steel. The spindle 8 has a spindle groove 50 to receive at least parts of the balls 48. The spindle groove 50 is formed on the outer surface of the rod 45. The hammer 47 has a hammer groove 51 to receive at least parts of the balls 48. The hammer groove 51 is formed on the inner surface of the inner cylinder 471 in the hammer 47. The balls 48 are placed between the spindle groove 50 and the hammer groove 51. The balls 48 roll along the spindle groove 50 and the hammer groove 51. The hammer 47 is movable together with the balls 48.

The spindle 8 and the hammer 47 are movable relative to each other in the front-rear direction and in the rotation direction within a movable range defined by the spindle groove 50 and the hammer groove 51. The hammer 47 is supported by the spindle 8 in a manner movable in the front-rear direction and in the rotation direction.

The flange 44 on the spindle 8 includes a first portion 44A and a second portion 44B. The first portion 44A includes a rim of the flange 44. The second portion 44B surrounds the rod 45. The first portion 44A surrounds the second portion 44B. The first portion 44A has a smaller dimension (thickness) than the second portion 44B in the front-rear direction. The front surface of the first portion 44A is located rearward from the front surface of the second portion 44B. The front surface of the second portion 44B is circular. The front surface of the first portion 44A is annular. The flange 44 has a step 44C at the boundary between the inner edge of the first portion 44A on the front surface and the outer edge of the second portion 44B on the front surface.

The first washer 94 is supported by the hammer 47 with balls 96. The first washer 94 is received in the recess 53. The first washer 94 according to the present embodiment surrounds the larger-diameter portion 471A of the hammer 47.

The balls 96 are placed between the front surface of the first washer 94 and the rear surface of the base 473. The multiple balls 96 surround the rotation axis AX. The rear surface of the base 473 has a recess 473R. The recess 473R is semicircular in a cross-section including the rotation axis AX. The recess 473R is annular in a plane orthogonal to the rotation axis AX. The multiple balls 96 are received in the recess 473R to surround the rotation axis AX.

The second washer 95 is located rearward from the first washer 94. The second washer 95 surrounds the smaller-diameter portion 471B of the hammer 47. The inner surface of the second washer 95 and the outer surface of the smaller-diameter portion 471B define a gap between them. The second washer 95 and the hammer 47 are movable relative to each other in the front-rear direction.

The first spring 91 is a coil spring. The first spring 91 surrounds the rotation axis AX of the spindle 8. In the present embodiment, the first spring 91 at least partially surrounds the inner cylinder 471 in the hammer 47. The first spring 91 at least partially surrounds the rod 45 of the spindle 8. The first spring 91 constantly urges the hammer 47 forward. The first spring 91 in a compressed state is between the hammer 47 and the first portion 44A of the flange 44.

The first spring 91 has a front portion received in the recess 53. The first spring 91 has its front end in contact with the rear surface of the first washer 94, and its rear end in contact with the front surface of the first portion 44A of the flange 44. The first spring 91 urges the hammer 47 forward with the first washer 94 in between. The first spring 91 has its rear end to come in contact with the surface of the step 44C while being in contact with the first portion 44A of the flange 44. This restricts radial movement of the first spring 91.

The second spring 92 is a coil spring. The second spring 92 surrounds the rotation axis AX of the spindle 8. In the present embodiment, the second spring 92 at least partially surrounds the inner cylinder 471 in the hammer 47. The second spring 92 at least partially surrounds the rod 45 of the spindle 8. The second spring 92 urges the hammer 47 forward when the hammer 47 moves backward. In other words, the second spring 92 urges the hammer 47 forward when the hammer 47 moves to a rearward position.

The second spring 92 has a shorter overall length than the first spring 91. The front end of the second spring 92 is thus located rearward from the front end of the first spring 91.

The second spring 92 has a front portion received in the recess 53. The second spring 92 has its front end in contact with the rear surface of the second washer 95, and its rear end in contact with the front surface of the second portion 44B of the flange 44.

The second washer 95 has a smaller outer diameter than the first washer 94. The second washer 95 is located radially inside the first spring 91. The first spring 91 and the second washer 95 stay out of contact from each other.

The second spring 92 is located radially inside the first spring 91.

The movement restrictor 90 restricts movement of the second spring 92 in the internal space of the hammer case 4, and restricts movement of the second spring 92 at least relative to the spindle 8.

The rear end of the second spring 92 is in contact with at least a part of the spindle 8. The movement restrictor 90 restricts movement of the rear end of the second spring 92 relative to the spindle 8. In other words, the movement restrictor 90 restricts free movement of the rear end of the second spring 92 relative to the spindle 8. In the present embodiment, the rear end of the second spring 92 is in contact with the flange 44 on the spindle 8, as described above. The movement restrictor 90 restricts movement of the rear end of the second spring 92 relative to the flange 44 on the spindle 8.

The movement restrictor 90 according to the present embodiment includes the third spring 93 for urging the second spring 92 backward.

The third spring 93 is a coil spring. The third spring 93 surrounds the rotation axis AX of the spindle 8. The second spring 92 and the third spring 93 extend in the front-rear direction parallel to the rotation axis AX. The third spring 93 is located frontward from the second spring 92. The third spring 93 according to the present embodiment surrounds the inner cylinder 471 in the hammer 47. The third spring 93 at least partially surrounds the larger-diameter portion 471A. In the state shown in FIG. 5, the third spring 93 at least partially surrounds the smaller-diameter portion 471B. The third spring 93 constantly urges the second spring 92 backward. The third spring 93 in a compressed state is between the hammer 47 and the front end of the second spring 92. The third spring 93 urges the second spring 92 backward, and urges the hammer 47 forward.

The third spring 93 is received in the recess 53. The third spring 93 has its front end in contact with the rear surface of the first washer 94, and its rear end in contact with the front surface of the second washer 95. The second washer 95 and the hammer 47 are movable relative to each other in the front-rear direction, as described above. The third spring 93 urges the second spring 92 backward with the second washer 95 in between. The third spring 93 urges the second spring 92 backward to press the rear end of the second spring 92 against the front surface of the second portion 44B of the flange 44. This restricts movement of the rear end of the second spring 92 relative to the flange 44.

The third spring 93 is located radially inside the first spring 91. The first spring 91 and the third spring 93 stay out of contact from each other.

The third spring 93 has a smaller urging force than the first spring 91 and the second spring 92. In other words, the third spring 93 has a smaller spring constant than the first spring 91 and the second spring 92. In the present embodiment, the third spring 93 has a smaller strand diameter than the first spring 91 and the second spring 92. The strand diameter refers to the diameter of a wire used for each spring.

In the present embodiment, the second spring 92 has a larger urging force than the first spring 91. In other words, the second spring 92 has a larger spring constant than the first spring 91. The second spring 92 may have a spring constant smaller than or equal to the spring constant of the first spring 91.

The hammer 47 is movable relative to the spindle 8 in the front-rear direction and in the rotation direction, as described above. The hammer 47 is movable between a reference position P0, a first position P1, and a second position P2 in the front-rear direction.

The reference position P0 is the frontmost position in the range of movement of the hammer 47 in the front-rear direction. The first position P1 is a position rearward from the reference position P0 in the range of movement of the hammer 47 in the front-rear direction. In the present embodiment, the first position P1 is the position at which the hammer 47 starts being urged by the second spring 92. The second position P2 is a position rearward from the first position P1 in the range of movement of the hammer 47 in the front-rear direction.

Figure 6:
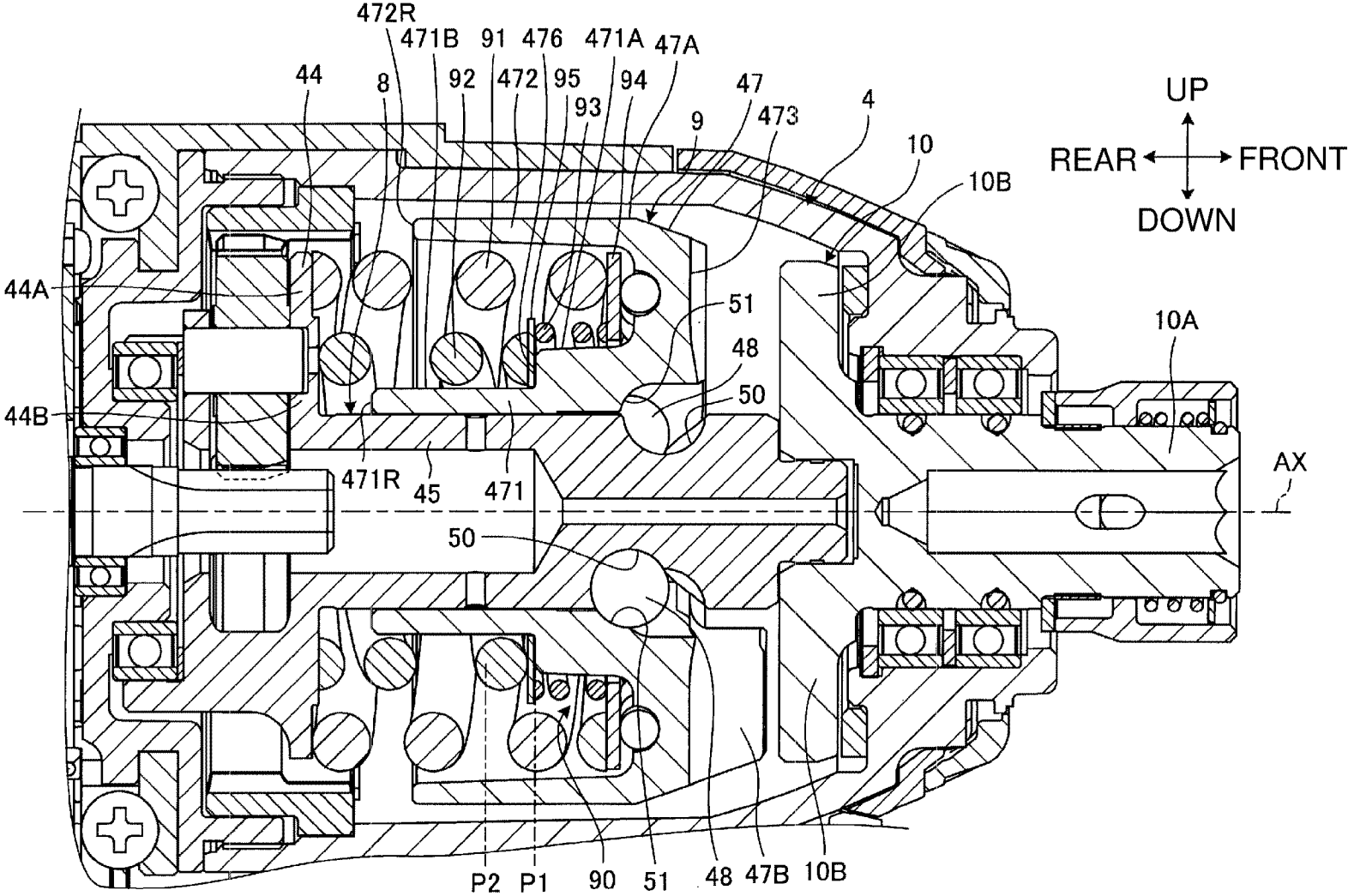
FIG. 6 is a longitudinal sectional view of the impact mechanism according to the first embodiment.
Figure 7:
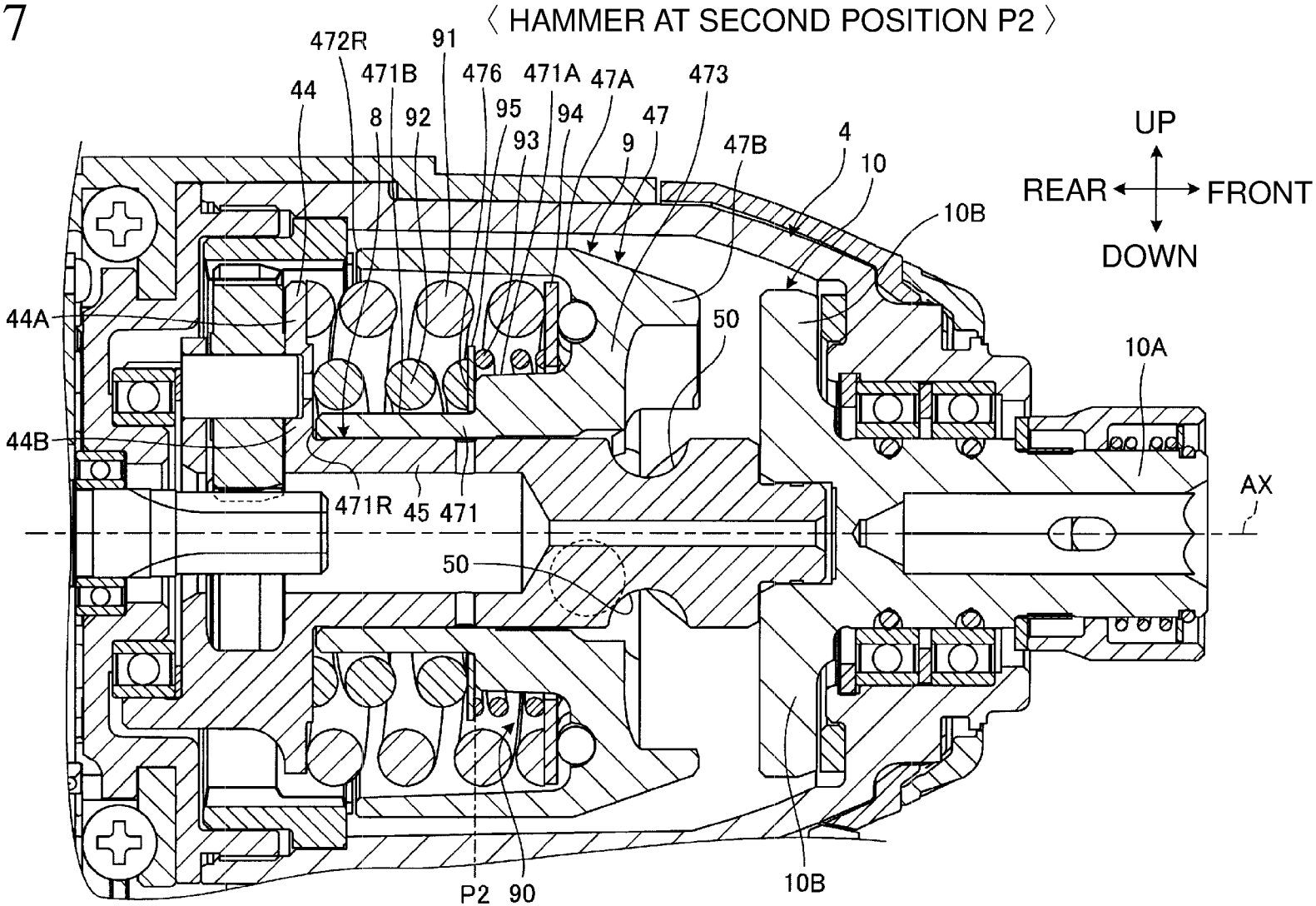
FIG. 7 is a longitudinal sectional view of the impact mechanism according to the first embodiment.

FIG. 5 shows the hammer 47 placed at the reference position P0. FIGS. 6 and 7 are longitudinal sectional views of the impact mechanism 9 according to the present embodiment. FIG. 6 shows the hammer 47 placed at the first position P1 rearward from the reference position P0. FIG. 7 shows the hammer 47 placed at the second position P2 rearward from the first position P1.

When the anvil 10 receives no load or receives a low load in a screw tightening operation, the hammer 47 is placed at the reference position P0. In this state, the hammer protrusions 47B are in contact with the anvil protrusions 10B. The motor 6 operates in this state to cause the anvil 10 to rotate together with the hammer 47 and the spindle 8. In other words, at the beginning of the screw tightening operation, the hammer 47 rotates at the reference position P0 as shown in FIG. 5. The screw tightening operation proceeds under no striking by the impact mechanism 9.

When the anvil 10 receives a higher load in the screw tightening operation, a rotational force generated by the motor 6 alone may be insufficient to rotate the anvil 10, causing the anvil 10 and the hammer 47 to stop rotating. The hammer 47 is movable relative to the spindle 8, with the balls 48 in between, in the front-rear direction and in the rotation direction. Although the hammer 47 stops rotating, the spindle 8 continues to rotate with a rotational force generated by the motor 6. When the hammer 47 stops rotating and the spindle 8 rotates, the balls 48 move backward as being guided along the spindle groove 50 and the hammer groove 51. The hammer 47 receives a force from the balls 48 to move backward with the balls 48. In other words, the hammer 47 moves backward when the anvil 10 stops rotating and the spindle 8 rotates.

For example, when the anvil 10 receives a load with a first predetermined value, the hammer 47 moves from the reference position P0 to the first position P1 as shown in FIG. 6.

As the hammer 47 moves backward, the hammer protrusions 47B are apart from the anvil protrusions 10B. The hammer 47 rotates at the first position P1.

When the anvil 10 receives a load with a second predetermined value higher than the first predetermined value, the hammer 47 moves from the first position P1 to the second position P2 as shown in FIG. 7. At the second position P2, the hammer protrusions 47B are also apart from the anvil protrusions 10B. The hammer 47 rotates at the second position P2.

Operation of Impact Tool

The operation of the impact tool 1 will now be described. For example, to perform a screw tightening operation on a workpiece, a tip tool for the screw tightening operation is placed into the insertion hole 55 in the anvil 10. The tip tool in the insertion hole 55 is held by the tool holder 11. After the tip tool is attached to the anvil 10, the operator grips the grip 22 and operates the trigger switch 14. Thus, power is fed from the battery pack 25 to the motor 6 through the controller 13 to activate the motor 6. This causes the rotor shaft 32 to rotate. The rotating rotor shaft 32 generates a rotational force, which is transmitted to the planetary gears 42 via the pinion gear 41. The planetary gears 42 revolve about the pinion gear 41 while rotating and meshing with the internal teeth of the internal gear 43. The planetary gears 42 are rotatably supported by the spindle 8 via the pin 42P. The revolving planetary gears 42 rotate the spindle 8 at a lower rotational speed than the rotor shaft 32.

FIGS. 2 to 5 show the hammer 47 placed at the reference position P0. The first spring 91 constantly urges the hammer 47 forward. The first spring 91 urges the hammer 47 forward to place the hammer 47 at the reference position P0. The third spring 93 also urges the hammer 47 forward.

When the hammer 47 is at the reference position P0, the third spring 93 has a smaller urging force than the second spring 92. When the hammer 47 is at the reference position P0, the second spring 92 substantially has a free length despite under a small urging force from the third spring 93.

When the hammer 47 is at the reference position P0, the hammer protrusions 47B are in contact with the anvil protrusions 10B. When the spindle 8 rotates in this state, the anvil 10 rotates together with the hammer 47 and the spindle 8. As the anvil 10 rotates, the screw tightening operation proceeds under no striking by the impact mechanism 9.

When the anvil 10 receives a load with a predefined or higher value during the screw tightening operation, the anvil 10 and the hammer 47 stop rotating. When the spindle 8 rotates in this state, the hammer 47 moves backward. Thus, the hammer protrusions 47B are apart from the anvil protrusions 10B. The hammer 47 moves backward to compress the first spring 91.

FIG. 6 shows the hammer 47 placed at the first position P1 rearward from the reference position P0. When the anvil 10 receives a load with a first predetermined value, the hammer 47 is placed at the first position P1 rearward from the reference position P0 as shown in FIG. 6. The hammer 47 rotates at the first position P1. The hammer 47 placed at the first position P1 compresses the first spring 91. When the hammer 47 is at the first position P1, the rear surface 476 of the hammer 47 is in contact with the front surface of the second washer 95. The first position P1 of the hammer 47 is the position at which the hammer 47 starts being urged by the second spring 92. In the present embodiment, the first position P1 of the hammer 47 is the position at which the hammer 47 has the rear surface 476 in contact with the front surface of the second washer 95. When the hammer 47 is at the first position P1, the rear end 471R of the inner cylinder 471 in the hammer 47 faces the front surface of the flange 44 with a first gap left between them.

Between the reference position P0 and the first position P1, the second washer 95 and the hammer 47 are movable relative to each other in the front-rear direction. The third spring 93 has a smaller urging force than the second spring 92. In the movement range of the hammer 47 from the reference position P0 to the first position P1, as shown in FIG. 6, the second spring 92 is not substantially compressed, and the third spring 93 is compressed. The second washer 95 moves on the smaller-diameter portion 471B toward the rear surface 476. The compressed third spring 93 surrounds the larger-diameter portion 471A. When the hammer 47 is placed at the first position P1 rearward from the reference position P0, the third spring 93 surrounds the larger-diameter portion 471A. The rear surface 476 of the hammer 47 thus comes in contact with the front surface of the second washer 95.

When the hammer 47 moves to the first position P1 in response to a load with the first predetermined value acting on the anvil 10, the hammer 47 receives an urging force from the first spring 91 to move forward. The hammer 47 then receives a force in the rotation direction from the balls 48. In other words, the hammer 47 moves forward while rotating. The hammer protrusions 47B then come in contact with the anvil protrusions 10B while rotating. Thus, the anvil protrusions 10B are struck by the hammer protrusions 47B in the rotation direction. The hammer 47 moving from the first position P1 to the reference position P0 strikes the anvil 10 with a first impact force. The anvil 10 receives both a rotational force from the motor 6 and an inertial force (first impact force) from the hammer 47. The anvil 10 thus rotates with high torque about the rotation axis AX. The screw is thus fastened to the workpiece under high torque.

FIG. 7 shows the hammer 47 placed at the second position P2 rearward from the first position P1. When the anvil 10 receives a load with a second predetermined value higher than the first predetermined value, the hammer 47 is placed at the second position P2 rearward from the first position P1 as shown in FIG. 7. The hammer 47 rotates at the second position P2. When the hammer 47 is placed at the second position P2, the first spring 91 and the second spring 92 are compressed, urging the hammer 47 forward. In the present embodiment, the second position P2 of the hammer 47 is the position at which the hammer 47 has the rear end 471R of its inner cylinder 471 facing the front surface of the flange 44 with a second gap narrower than the first gap left in between. The second gap is very small. When the hammer 47 is at the second position P2, the balls 48 are located at the rear end of the spindle groove 50 on the spindle 8.

When the hammer 47 moves to the second position P2 in response to a load with the second predetermined value acting on the anvil 10, the hammer 47 receives an urging force from the first spring 91 and the second spring 92 to move forward. The hammer 47 moves forward while rotating. The hammer protrusions 47B then come in contact with the anvil protrusions 10B while rotating. Thus, the anvil protrusions 10B are struck by the hammer protrusions 47B in the rotation direction. The hammer 47 moving from the second position P2 to the reference position P0 strikes the anvil 10 with a second impact force larger than the first impact force. The anvil 10 receives both a rotational force from the motor 6 and an inertial force (second impact force) from the hammer 47. The anvil 10 thus rotates with high torque about the rotation axis AX. The screw is thus fastened to the workpiece under high torque.

Figure 8:
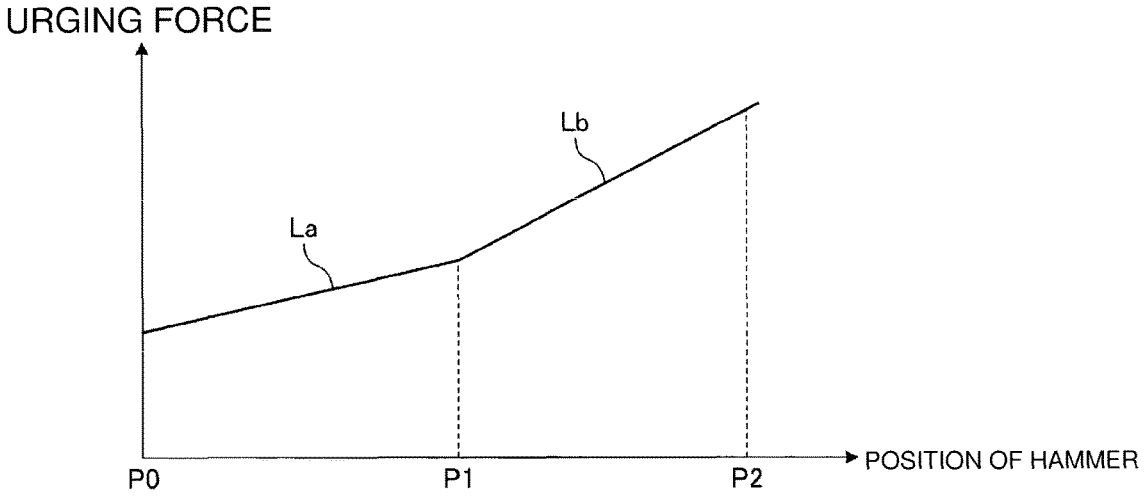
FIG. 8 is a graph showing the spring characteristics of the impact mechanism according to the first embodiment.

FIG. 8 is a graph showing the spring characteristics of the impact mechanism 9 according to the present embodiment. In FIG. 8, the horizontal axis indicates the position of the hammer 47, and the vertical axis indicates the urging force applied to the hammer 47. The line La in FIG. 8 indicates the urging force varying based on the position of the hammer 47.

The second spring 92 and the third spring 93 are each located radially inside the first spring 91, as described above. The first spring 91 and the second spring 92 are arranged in parallel. The first spring 91 and the third spring 93 are arranged in parallel. The second spring 92 is located rearward from the third spring 93. The second spring 92 and the third spring 93 are arranged in series.

When the hammer 47 is placed at the reference position P0, the first spring 91 and the third spring 93 are compressed. When the hammer 47 is placed at the reference position P0, the second spring 92 has an equilibrium length. The hammer 47 is urged forward by the first spring 91 and the third spring 93. The second spring 92 is urged backward by the third spring 93.

When the hammer 47 is placed frontward from the first position P1, the combined spring constant Ka of the first spring 91, the second spring 92, and the third spring 93 is expressed by the formula (1) below, where $k_1$ is the spring constant of the first spring 91, $k_2$ is the spring constant of the second spring 92, and $k_3$ is the spring constant of the third spring 93.

$$Ka=k_1+(k_2\times k_3)/(k_2+k_3) \quad (1)$$

In FIG. 8, the slope of the line La between the reference position P0 and the first position P1 indicates the combined spring constant Ka. As the hammer 47 moves away from the reference position P0 and approaches the first position P1, the first spring 91 and the third spring 93 are compressed more and thus each apply a larger urging force to the hammer 47. In the movement range of the hammer 47 from the reference position P0 to the first position P1, the hammer 47 receives an urging force from each of the first spring 91 and the third spring 93 substantially without receiving an urging force from the second spring 92.

When the hammer 47 is placed rearward from the first position P1, the hammer 47 is pressed against the second spring 92 with the second washer 95 in between. This causes the second spring 92 to be compressed, allowing the hammer 47 to be substantially free from an urging force from the third spring 93. When the hammer 47 is placed rearward from the first position P1, the combined spring constant Kb of the first spring 91 and the second spring 92 is expressed by the formula (2) below.

$$Kb=k_1+k_2 \quad (2)$$

In FIG. 8, the slope of the line Lb between the first position P1 and the second position P2 indicates the combined spring constant Kb. As the hammer 47 moves away from the first position P1 and approaches the second position P2, the first spring 91 and the second spring 92 are compressed more and thus each apply a larger urging force to the hammer 47. In the movement range of the hammer 47 from the first position P1 to the second position P2, the hammer 47 receives an urging force from the first spring 91 and the second spring 92.

As described above, the impact mechanism 9 according to the present embodiment includes the first spring 91 and the second spring 92. The second spring 92 increases the impact force from the impact mechanism 9. The impact mechanism 9 according to the present embodiment includes the movement restrictor 90 for restricting movement of the second spring 92. The movement restrictor 90 restricts free movement of the second spring 92. The second spring 92 moving freely may touch, for example, the hammer 47 or the spindle 8, producing abnormal noise. The second spring 92 moving freely may also idly spin under the rotational inertia when the rotating spindle 8 stops, producing abnormal noise. The structure according to the present embodiment restricts free movement of the second spring 92 and reduces abnormal noise.

The movement restrictor 90 restricts movement of the second spring 92 relative to the spindle 8. This reduces the likelihood that the second spring 92 touches the hammer 47 or the spindle 8, and the likelihood that the second spring 92 idly spins under the rotational inertia when the rotating spindle 8 stops.

The rear end of the second spring 92 is in contact with at least a part of the spindle 8. The movement restrictor 90 restricts movement of the rear end of the second spring 92 relative to the spindle 8. In other words, the movement restrictor 90 restricts free movement of the rear end of the second spring 92 relative to the spindle 8. The rear end of the second spring 92 in contact with at least a part of the spindle 8 is restricted from moving relative to the spindle 8. This effectively restricts movement of the second spring 92.

The movement restrictor 90 according to the present embodiment includes the third spring 93 for urging the second spring 92 backward. The simple structure effectively restricts movement of the second spring 92.

The third spring 93 urges the second spring 92 to press the rear end of the second spring 92 against the flange 44 on the spindle 8. The flange 44 stably supports the rear end of the second spring 92. This structure effectively restricts movement of the second spring 92.

The first spring 91, the second spring 92, and the third spring 93 each surround the rotation axis AX of the spindle 8. The second spring 92 and the third spring 93 are each located radially inside the first spring 91. In other words, the first spring 91 is arranged in parallel to the second spring 92 and the third spring 93. The impact tool 1 can thus remain compact.

The second spring 92 and the third spring 93 extend in the front-rear direction parallel to the rotation axis AX. In other words, the second spring 92 and the third spring 93 are arranged in series. The third spring 93 according to the present embodiment is located frontward from the second spring 92. The third spring 93, which is arranged in series with the second spring 92, appropriately urges the second spring 92.

The front end of the first spring 91 and the front end of the third spring 93 are in contact with the rear surface of the first washer 94. The front end of the first spring 91 and the front end of the third spring 93 are stably supported by the first washer 94.

The rear end of the third spring 93 and the front end of the second spring 92 are in contact with the second washer 95. The rear end of the third spring 93 is in contact with the front surface of the second washer 95. The front end of the second spring 92 is in contact with the rear surface of the second washer 95. The rear end of the third spring 93 and the front end of the second spring 92 are stably supported by the second washer 95.

The second washer 95 is located radially inside the first spring 91 and out of contact with the first spring 91. The first spring 91 operates appropriately.

The first washer 94 and the hammer 47 are immovable relative to each other in the front-rear direction. The first spring 91 and the third spring 93 are thus appropriately compressed when the hammer 47 moves backward. The second washer 95 and the hammer 47 are movable relative to each other in the front-rear direction. In the movement range of the hammer 47 from the reference position P0 to the first position P1, the second washer 95 moves relative to the hammer 47. The second spring 92 remains uncompressed. The third spring 93 urges the second spring 92 backward with the second washer 95 in between.

The hammer 47 includes the larger-diameter portion 471A on which the first washer 94 is located, and the smaller-diameter portion 471B on which the second washer 95 is located. As shown in FIG. 6, when the hammer 47 is placed at the first position P1, the third spring 93 in a compressed state surrounds the larger-diameter portion 471A. Thus, the rear surface 476 of the hammer 47 can be sufficiently in contact with the front surface of the second washer 95.

The first position P1 of the hammer 47 is the position at which the hammer 47 has the rear surface 476 in contact with the front surface of the second washer 95. In the movement range of the hammer 47 from the reference position P0 to the first position P1, the first spring 91 urges the hammer 47 forward, and the second spring 92 substantially does not urge the hammer 47. At the beginning of a screw tightening operation, the hammer 47 receives an urging force from the first spring 91 alone, and thus can move backward under a low load acting on the anvil 10. In other words, the impact mechanism 9 can provide strikes in light work.

When the hammer 47 moves backward from the first position P1 with the rear surface 476 of the hammer 47 in contact with the front surface of the second washer 95, the first spring 91 and the second spring 92 urge the hammer 47 forward. The hammer 47 can strike the anvil 10 in the rotation direction with a large impact force.

The third spring 93 has a smaller urging force than the first spring 91 and the second spring 92. Thus, in the movement range of the hammer 47 from the reference position P0 to the first position P1, the hammer 47 receives an urging force substantially from the first spring 91 alone.

The third spring 93 has a smaller strand diameter than the first spring 91 and the second spring 92. The third spring 93 can thus produce an intended urging force.

The second spring 92 has a larger urging force than the first spring 91. At the beginning of a screw tightening operation, the hammer 47 receives an urging force from the first spring 91 alone, and thus can move backward under a low load acting on the anvil 10.

In the present embodiment, when the hammer 47 is placed at the second position P2, the rear end 471R of the inner cylinder 471 faces the front surface of the flange 44 with the second gap left between them, as described with reference to FIG. 7. In some embodiments, an elastic body may be placed between the rear end 471R of the inner cylinder 471 and the front surface of the flange 44 to avoid direct contact between them.

In the present embodiment, the rear end of the first spring 91 is in direct contact with the front surface of the flange 44, and the rear end of the second spring 92 is in direct contact with the front surface of the flange 44. In some embodiments, a washer may be placed between the rear end of the first spring 91 and the flange 44, and between the rear end of the second spring 92 and the flange 44, to avoid direct contact between them.

Second Embodiment

A second embodiment will now be described. The same or corresponding components as those in the above embodiment are given the same reference numerals herein, and will be described briefly or will not be described.

Figure 9:
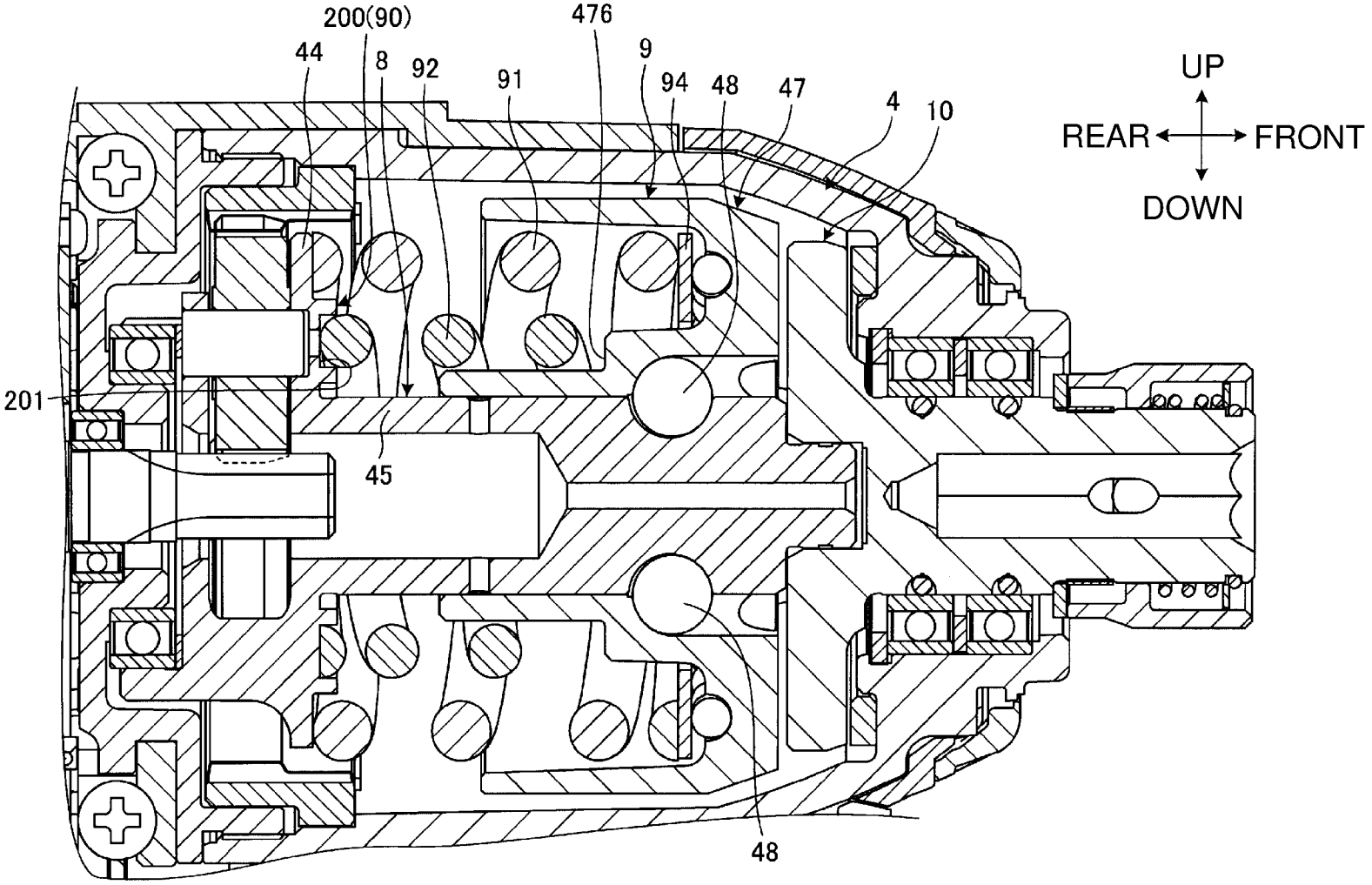
FIG. 9 is a longitudinal sectional view of an impact mechanism according to a second embodiment.

FIG. 9 is a longitudinal sectional view of an impact mechanism 9 according to the present embodiment. A movement restrictor 90 restricts movement of the rear end of the second spring 92 relative to a spindle 8. In other words, the movement restrictor 90 restricts free movement of the rear end of the second spring 92 relative to the spindle 8. As shown in FIG. 9, the movement restrictor 90 includes a fixing portion 200 for fastening the rear end of the second spring 92 to at least a part of the spindle 8. The fixing portion 200 according to the present embodiment is located on a flange 44 on the spindle 8. The fixing portion 200 includes a groove 201 on the front surface of the flange 44. The rear end of the second spring 92 is press-fitted in the groove 201 on the fixing portion 200, thus being fastened to the flange 44. This restricts movement of the rear end of the second spring 92 relative to the spindle 8.

In the present embodiment, the third spring 93 and the second washer 95 described in the first embodiment may be eliminated. The front end of the second spring 92 faces the rear surface 476 of the hammer 47.

FIG. 9 shows the hammer 47 placed at the reference position P0. In this state, the front end of the second spring 92 is separate from the hammer 47. In this state, the front end of the second spring 92 faces the rear surface 476 of the hammer 47 with a gap left between them in the front-rear direction.

When the hammer 47 is at the first position P1 rearward from the reference position P0 during a screw tightening operation, the front end of the second spring 92 comes in contact with the rear surface 476 of the hammer 47. In the present embodiment, the first position P1 of the hammer 47 is the position at which the hammer 47 has the rear surface 476 in contact with the front end of the second spring 92.

In the movement range of the hammer 47 from the reference position P0 to the first position P1, the first spring 91 is compressed, and the second spring 92 is not compressed. In other words, the hammer 47 receives an urging force from the first spring 91 alone, without receiving an urging force from the second spring 92.

When the hammer 47 moves backward from the first position P1 with the rear surface 476 of the hammer 47 in contact with the front end of the second spring 92, the first spring 91 and the second spring 92 are compressed to urge the hammer 47 forward.

Thus, the structure according to the present embodiment also restricts movement of the second spring 92.

In the present embodiment, the rear end of the second spring 92 may be fastened to the flange 44 by, for example, welding. The fixing portion 200 may include a weld for fastening the rear end of the second spring 92 to the flange 44.

Third Embodiment

A third embodiment will now be described. The same or corresponding components as those in the above embodiment are given the same reference numerals herein, and will be described briefly or will not be described.

Figure 10:
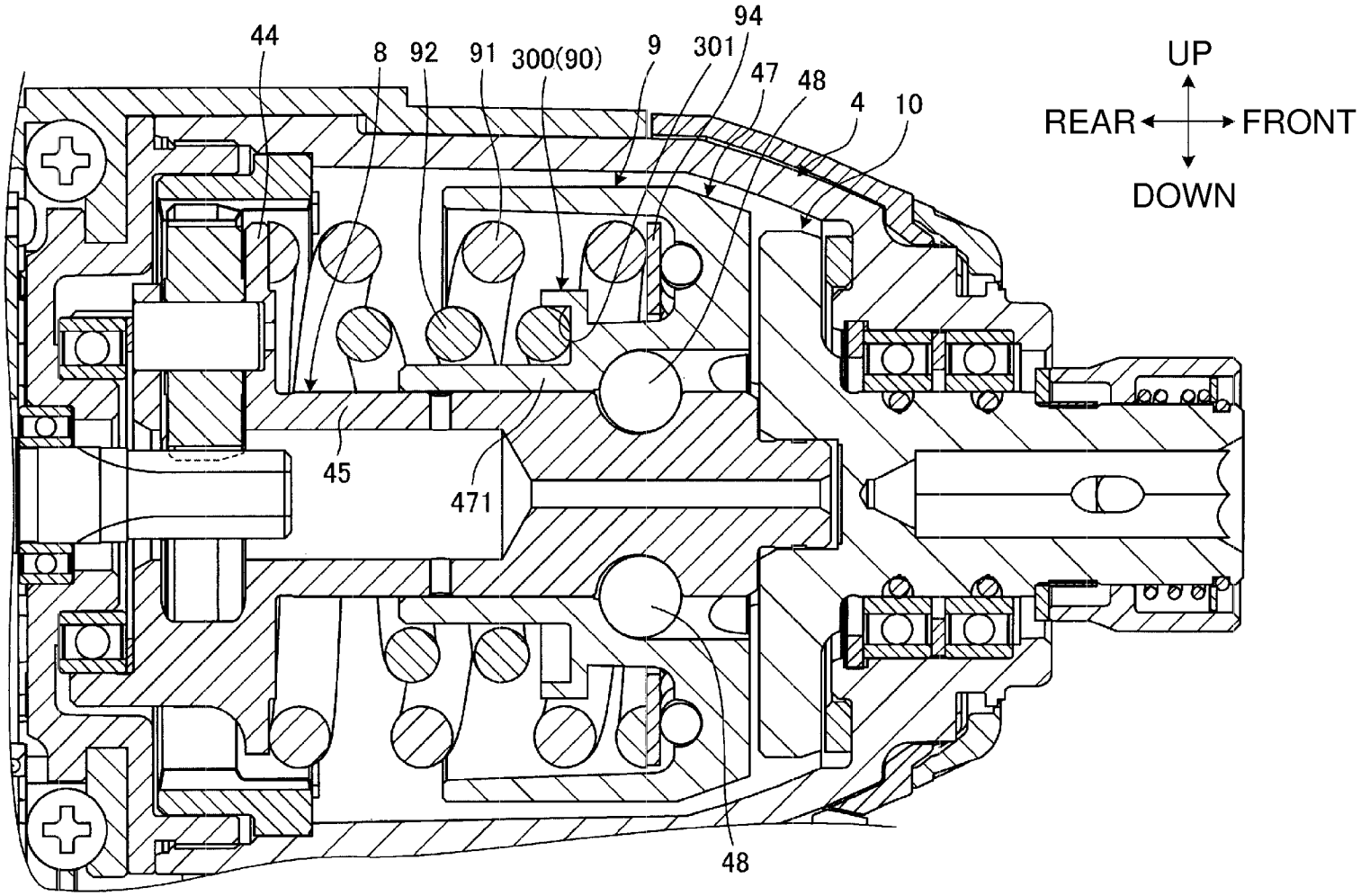
FIG. 10 is a longitudinal sectional view of an impact mechanism according to a third embodiment.

FIG. 10 is a longitudinal sectional view of an impact mechanism 9 according to the present embodiment. A movement restrictor 90 according to the present embodiment restricts movement of the front end of the second spring 92 relative to a hammer 47. In other words, the movement restrictor 90 restricts free movement of the front end of the second spring 92 relative to the hammer 47. As shown in FIG. 10, the movement restrictor 90 includes a fixing portion 300 for fastening the front end of the second spring 92 to at least a part of the hammer 47. The fixing portion 300 according to the present embodiment is located on an inner cylinder 471 in the hammer 47. The fixing portion 300 includes a groove 301 on the inner cylinder 471. The front end of the second spring 92 is press-fitted in the groove 301 on the fixing portion 300, thus being fastened to the inner cylinder 471. This restricts movement of the front end of the second spring 92 relative to the hammer 47.

In the present embodiment as well, the third spring 93 and the second washer 95 described in the first embodiment may be eliminated. The rear end of the second spring 92 faces the front surface of the flange 44 on the spindle 8.

FIG. 10 shows the hammer 47 placed at the reference position P0. In this state, the rear end of the second spring 92 is separate from the spindle 8. In this state, the rear end of the second spring 92 faces the front surface of the flange 44 on the spindle 8 with a gap left between them in the front-rear direction.

When the hammer 47 is at the first position P1 rearward from the reference position P0, the rear end of the second spring 92 is in contact with the front surface of the flange 44. In the present embodiment, the first position P1 of the hammer 47 is the position at which the flange 44 has the front surface in contact with the rear end of the second spring 92.

In the movement range of the hammer 47 from the reference position P0 to the first position P1, the first spring 91 is compressed, and the second spring 92 is not compressed. The hammer 47 then receives an urging force from the first spring 91, without receiving an urging force from the second spring 92.

When the hammer 47 moves backward from the first position P1 with the front surface of the flange 44 in contact with the rear end of the second spring 92, the first spring 91 and the second spring 92 are compressed to urge the hammer 47 forward.

Thus, the structure according to the present embodiment also restricts movement of the second spring 92.

In the present embodiment, the front end of the second spring 92 may be fastened to the inner cylinder 471 by, for example, welding. The fixing portion 300 may include a weld for fastening the front end of the second spring 92 to the inner cylinder 471.

OTHER EMBODIMENTS

In the above embodiments, the hammer body 47A includes the inner cylinder 471 and the outer cylinder 472. In some embodiments, the outer cylinder 472 may be eliminated. A space may instead be left around the inner cylinder 471 for accommodating the front end of the first spring 91 and the front end of the second spring 92.

The components described in the above embodiments may also be used for an impact wrench including an anvil 10 having a square tip and having no insertion hole 55 or no tool holder 11.

In the above embodiments, the impact tool 1 is powered by the battery pack 25 mounted on the battery mount 5. In some embodiments, the impact tool 1 may use utility power (alternating-current power supply).

In the above embodiments, the impact tool 1 is a power tool including the motor 6 (electric motor) as a power source. In some embodiments, the impact tool 1 may be powered by a pneumatic motor driven by compressed air, a hydraulic motor, or an engine-driven motor.

REFERENCE SIGNS LIST

1 impact tool
2 housing
2L left housing
2R right housing
2S screw
2T screw
3 rear case
4 hammer case
4C hammer case cover
5 battery mount
6 motor
7 reduction mechanism
8 spindle
9 impact mechanism
10 anvil
10A anvil body
10B anvil protrusion
11 tool holder
12 fan
13 controller
14 trigger switch
14A trigger
14B switch body
15 forward-reverse switch lever
16 operation panel
17 mode switch
18 lamp
19 inlet
20A first outlet
20B second outlet
21A motor compartment
21B hammer case covering portion
22 grip
23 controller compartment
24 bearing retainer
25 battery pack
26 stator
27 rotor
28 stator core

29 front insulator
29S screw
30 rear insulator
31 coil
32 rotor shaft
33 rotor core
34 permanent magnet
35 sensor permanent magnet
36 resin sleeve
37 sensor board
38 coil terminal
39 front bearing
40 rear bearing
41 pinion gear
42 planetary gear
42P pin
43 internal gear
44 flange
44A first portion
44B second portion
44C step
45 rod
46 rear bearing
47 hammer
47A hammer body
47B hammer protrusion
48 ball
50 spindle groove
51 hammer groove
53 recess
55 insertion hole
56 front bearing
57 hole
58 hole
61 bush
62 controller case
63 opening
64 operation switch
71 ball
72 leaf spring
73 sleeve
73A sleeve body
73B protrusion
73C first groove
73D second groove
74 coil spring
75 positioner
76 supporting recess
76M through-hole
77 stop ring
78 stopper
80 groove
81 groove
90 movement restrictor
91 first spring
92 second spring
93 third spring
94 first washer
95 second washer
96 ball
101 feed port
102 flow channel
103 internal space
200 fixing portion
201 groove
300 fixing portion
301 groove
471 inner cylinder
471A larger-diameter portion
471B smaller-diameter portion
471R rear end
472 outer cylinder
472R rear end
473 base
473R recess
474 outer surface
475 outer surface
476 rear surface
AX rotation axis
P0 reference position
P1 first position
P2 second position

What is claimed is:

1. An impact tool, comprising:
a motor;
a spindle rotatable with a rotational force generated by the motor;
a hammer supported by the spindle in a manner movable in a front-rear direction and in a rotation direction;
an anvil configured to be struck by the hammer in the rotation direction;
a first spring configured to constantly urge the hammer forward;
a second spring configured to resist the hammer moving backward from a reference position;
a hammer case accommodating the hammer, the first spring, and the second spring; and
a third spring configured to urge the second spring backward to restrict movement of the second spring in an internal space of the hammer case.

2. The impact tool according to claim 1, wherein
the third spring is configured to restrict movement of the second spring relative to the spindle.

3. The impact tool according to claim 1, wherein
the second spring has a rear end in contact with at least a part of the spindle, and
the third spring is configured to restrict movement of the rear end of the second spring.

4. The impact tool according to claim 1, wherein
the spindle includes a flange in contact with a rear end of the second spring, and
the third spring is configured to urge the second spring to press the rear end of the second spring against the flange.

5. The impact tool according to claim 1, wherein
each of the first spring, the second spring, and the third spring surrounds a rotation axis of the spindle, and
each of the second spring and the third spring is radially inside the first spring.

6. The impact tool according to claim 5, wherein
the second spring and the third spring extend in a direction parallel to the rotation axis.

7. The impact tool according to claim 5, further comprising:
a first washer supported by the hammer,
wherein the first spring has a front end in contact with the first washer, and the third spring has a front end in contact with the first washer.

8. The impact tool according to claim 7, further comprising:
a second washer located rearward from the first washer and supported by the hammer, wherein the third spring has a rear end in contact with the second washer, and the second spring has a front end in contact with the second washer.

9. The impact tool according to claim 8, wherein the second washer is radially inside the first spring.

10. The impact tool according to claim 9, wherein the first washer and the hammer are immovable relative to each other in the front-rear direction, the second washer and the hammer are movable relative to each other in the front-rear direction, and the third spring is configured to urge the second spring backward with the second washer in between.

11. The impact tool according to claim 10, wherein the hammer includes a larger-diameter portion on which the first washer is located, and a smaller-diameter portion on which the second washer is located, and the third spring is configured to surround the larger-diameter portion when the hammer is at a first position that is rearward from the reference position.

12. The impact tool according to claim 11, wherein the hammer has a rear surface between an outer surface of the larger-diameter portion and an outer surface of the smaller-diameter portion and facing rearward, the hammer is configured such that the rear surface is in contact with the second washer when the hammer is at the first position, and the first spring is configured to urge the hammer forward in a movement range of the hammer from the reference position to the first position.

13. The impact tool according to claim 12, wherein the first spring and the second spring are configured to urge the hammer forward when the hammer has the rear surface in contact with the second washer and moves backward from the first position.

14. The impact tool according to claim 1, wherein the third spring has a smaller urging force than the first spring and the second spring.

15. The impact tool according to claim 1, wherein the third spring has a smaller strand diameter than the first spring and the second spring.

16. The impact tool according to claim 1, wherein the third spring is configured to restrict movement of the second spring relative to the hammer.

17. The impact tool according to claim 1, wherein the second spring has a larger urging force than the first spring.

18. An impact tool, comprising:

a motor;

a spindle rotatable with a rotational force generated by the motor;

a hammer supported by the spindle in a manner movable in a front-rear direction and in a rotation direction;

an anvil configured to be struck by the hammer in the rotation direction;

a first spring configured to constantly urge the hammer forward;

a second spring configured to resist the hammer moving backward from a reference position;

a hammer case accommodating the hammer, the first spring, and the second spring; and a fixing portion fastening a rear end of the second spring to at least a part of the spindle, wherein the second spring and the hammer are configured such that:

the second spring has a front end spaced from the hammer to have a gap between the front end and the hammer in the front-rear direction when the hammer is at the reference position, and the front end is in contact with the hammer when the hammer is at a first position that is rearward from the reference position.

19. The impact tool according to claim 18, wherein the reference position is a forwardmost position of the hammer.

20. The impact tool according to claim 19, wherein:

the hammer has a hammer/spring contact surface that contacts the front end of the second spring in the front-rear direction when the hammer is in the first position; and the hammer/spring contact surface is spaced from the front end of the second spring in the front-rear direction when the hammer is in the reference position.

21. An impact tool, comprising:

a motor;

a spindle rotatable with a rotational force generated by the motor;

a hammer supported by the spindle in a manner movable in a front-rear direction and in a rotation direction;

an anvil configured to be struck by the hammer in the rotation direction;

a first spring configured to constantly urge the hammer forward;

a second spring configured to resist the hammer moving backward from a reference position;

a hammer case accommodating the hammer, the first spring, and the second spring; and a fixing portion fastening a front end of the second spring to at least a part of the hammer;

wherein the second spring, the spindle and the hammer are configured such that:

the second spring has a rear end spaced from the spindle to have a gap between the rear end and the spindle in the front-rear direction when the hammer is at the reference position, and the rear end is in contact with the spindle when the hammer is at a first position that is rearward from the reference position.

22. The impact tool according to claim 21, wherein the reference position is a forwardmost position of the hammer.

23. The impact tool according to claim 22, wherein:

the spindle has a spindle/spring contact surface that contacts the rear end of the second spring in the front-rear direction when the hammer is in the first position; and the spindle/spring contact surface is spaced from the rear end of the second spring in the front-rear direction when the hammer is in the reference position.

* * * * *